US010710781B2

(12) United States Patent
Battaglia et al.

(10) Patent No.: US 10,710,781 B2
(45) Date of Patent: Jul. 14, 2020

(54) RESEALABLE COVER FOR CONTAINERS

(71) Applicant: William Battaglia, North Haledon, NJ (US)

(72) Inventors: William Battaglia, North Haledon, NJ (US); Robert G. Dickie, King City (CA)

(73) Assignee: William Battaglia, North Haledon, NJ (US)

( * ) Notice: Subject to any disclaimer, the term of this patent is extended or adjusted under 35 U.S.C. 154(b) by 3 days.

(21) Appl. No.: 16/278,367

(22) Filed: Feb. 18, 2019

(65) Prior Publication Data

US 2019/0177052 A1 Jun. 13, 2019

Related U.S. Application Data

(63) Continuation-in-part of application No. 15/800,164, filed on Nov. 1, 2017, now Pat. No. 10,049,940, (Continued)

(51) Int. Cl.

| | |
|---|---|
| ***B65D 51/00*** | (2006.01) |
| ***B65D 55/16*** | (2006.01) |
| ***B65D 43/16*** | (2006.01) |
| ***B65D 51/16*** | (2006.01) |
| ***B65D 43/18*** | (2006.01) |

(Continued)

(52) U.S. Cl.

CPC ..... *B65D 51/007* (2013.01); *B65D 43/162* (2013.01); *B65D 43/18* (2013.01); *B65D 51/1661* (2013.01); *B65D 55/16* (2013.01); *A47G 19/2272* (2013.01); *B65D 43/022* (2013.01); *B65D 43/16* (2013.01); *B65D 2517/0041* (2013.01); *B65D 2543/00092* (2013.01); *B65D 2543/00296* (2013.01); *B65D 2543/00842* (2013.01)

(58) Field of Classification Search

None

See application file for complete search history.

(56) References Cited

U.S. PATENT DOCUMENTS

| | | | |
|---|---|---|---|
| 2,690,861 | A | 5/1950 | Tupper |
| 2,889,087 | A | 8/1956 | Paull et al. |

(Continued)

FOREIGN PATENT DOCUMENTS

| | | |
|---|---|---|
| CN | 105923250 | 9/2016 |

*Primary Examiner* — Minh Loan Tran

(74) *Attorney, Agent, or Firm* — Sand, Sebolt & Wernow Co., LPA

(57) ABSTRACT

A resealable cover for a beverage container that holds a carbonated beverage. The cover includes a base engageable with a rim of the container and a lid movable between an open and closed position relative to the base. When in the closed position, a passageway is defined between a portion of the lid and a portion of the base. The passageway permits fluid communication between air surrounding an exterior surface of the cover and a space defined between the lid and an opening in the container. Pressure that builds up under the lid from gas escaping from the liquid may be relieved by outgassing through the passageway. The cover includes latches on the base that engage in notches on the lid to help lock the lid in place. The lid is rotated relative to the base to release the latches and permit the lid to be opened.

27 Claims, 26 Drawing Sheets

Related U.S. Application Data which is a continuation-in-part of application No. 15/453,671, filed on Mar. 8, 2017, now Pat. No. 10,336,508.

(60) Provisional application No. 62/421,161, filed on Nov. 11, 2016.

(51) Int. Cl.
*A47G 19/22* (2006.01)
*B65D 43/02* (2006.01)

(56) References Cited

U.S. PATENT DOCUMENTS

| | | | | |
|---|---|---|---|---|
| 3,419,181 | A | 12/1968 | Stec | |
| 3,977,563 | A | 8/1976 | Holt | |
| 4,310,102 | A | 1/1982 | Walter | |
| 4,415,097 | A | 11/1983 | Meins | |
| 4,883,192 | A | 11/1989 | Krugman | |
| 4,932,555 | A * | 6/1990 | La Barge | B65D 55/16 215/306 |
| 4,948,009 | A | 8/1990 | Sawatani | |
| 5,088,614 | A | 2/1992 | Dumestre | |
| D353,328 | S | 12/1994 | Nuffer | |
| 5,562,205 | A | 10/1996 | Diaz | |
| 5,695,084 | A | 12/1997 | Chmela et al. | |
| 5,695,086 | A | 12/1997 | Viola | |
| 5,975,346 | A | 11/1999 | Imperato et al. | |
| D534,420 | S | 1/2007 | Fager | |
| 7,644,832 | B1 | 1/2010 | Tsengas et al. | |
| 8,720,740 | B2 * | 5/2014 | Bratsch | B65D 47/265 220/821 |
| 9,637,269 | B1 * | 5/2017 | Zabaleta | B65D 41/04 |
| 2005/0218013 | A1 | 10/2005 | Tabeshnekoo | |
| 2007/0039836 | A1 | 2/2007 | Borg et al. | |
| 2007/0205198 | A1 | 9/2007 | Huber | |
| 2007/0257037 | A1 | 11/2007 | Scarborough | |
| 2009/0008272 | A1 | 1/2009 | Baylav | |
| 2009/0084753 | A1 | 4/2009 | Ramos | |
| 2012/0073997 | A1 | 3/2012 | Borg | |
| 2012/0181280 | A1 | 7/2012 | Barbier et al. | |
| 2013/0134165 | A1 | 5/2013 | Ciccotelli et al. | |

* cited by examiner

RESEALABLE COVER FOR CONTAINERS

CROSS REFERENCE TO RELATED APPLICATIONS

This application is a Continuation-in-Part of U.S. patent application Ser. No. 15/800,164 filed Nov. 1, 2017, which is a Continuation-in-Part of U.S. patent application Ser. No. 15/453,671 filed Mar. 8, 2017, which application claims the benefit of U.S. Provisional Application Ser. No. 62/421,161 filed on Nov. 11, 2016, the entire disclosures of which are incorporated herein by reference.

BACKGROUND

Technical Field

The present disclosure relates generally to containers for materials. More particularly, the present disclosure is directed to cans or containers for holding beverages, foods or other substances and materials. Specifically, the present disclosure is directed to a resealable cover for a container that includes a relief passageway which permits some outgassing from under the cover and thereby prevents excess pressure from building up under the lid. A child-safe version of the cover includes a locking mechanism that substantially reduces the likelihood a child can move the lid to an open position.

Background Information

Aluminum cans come in different sizes and are usually described the fluid size and width of the lid or top of the can. Standard lid sizes in North America may be about 142 mm (about 5½ inches), about 146 mm (about 5¾ inches), and about 149 mm (about 6 inches) in diameter.

Many cans are utilized to hold carbonated beverages such as pop or beer. Aluminum can lids typically include a pull-tab that is removed to allow access to the contents retained in the interior. Once the pull-tab has been used, the can cannot be resealed. The contents of smaller cans are typically consumed but this is not always the case with larger cans. With larger cans people may try and save whatever remains in the can for later consumption by placing the can in a refrigerator or a cooler. This may lead to a lot of the carbonation in the pop or beer being lost over time. Additionally, if the can is bumped, it may tip over and spill some of the contents through the opening. Furthermore, leaving the can open may also provide access to the interior for insects such as flies and bees. Contact with flies, for example, may lead to contamination of the beverage within the can. If bees manage to enter the can through the opening in the lid, when a person next drinks from the can they may be stung.

One of the solutions to the above issues may be that a consumer will place a piece of plastic film or wrap over the top of the can. While this solution may slow down the loss of carbonation from a beverage and prevent spillage therefrom to a limited extent, the seal around the plastic film is typically not adequate to prevent spillage if the can is knocked over nor will the film necessarily prevent ingress of insects. This is because plastic films have a tendency not to stick very well and therefore can easily slide off the top of the can or container. A variety of different type of closure devices have also been proposed in the prior art.

SUMMARY

While a number of devices have been proposed in the prior art to close off access to a can interior, there remains a need in the art for a simple but effective device for sealing opened beverage containers.

The resealable cover disclosed herein is a simple and effective device for sealing opened beverage containers so that the tendency of leakage therefrom is reduced if the container is bumped or knocked over. The resealable cover disclosed herein furthermore helps reduce the loss of carbonation from a can that has been previously opened. Furthermore, the resealable cover disclosed herein has a reduced tendency to be pushed open by pressure building up under the cover as gas escapes from a beverage retained within the can. Still further, if pressure builds up to a sufficient degree under the resealable cover, only a portion of the cover may tend to lift off the can rim, thereby leaving the can substantially sealed. The lifting of the portion of the cover may also release the pressure build up and thereby prevent the rest of the cover from disengaging from the can.

A resealable cover for a beverage container that holds a carbonated beverage is disclosed. The cover includes a base engageable with a rim of the container and a lid movable between an open and closed position relative to the base. When in the closed position, a passageway (or bypass vent) is defined between a portion of the lid and a portion of the base. The passageway permits fluid communication between air surrounding an exterior surface of the cover and a space defined between the lid and an opening in the container. Pressure that builds up under the lid from gas escaping from the liquid may be relieved by outgassing through the passageway. A child-safe version of the cover includes latches on the base that engage in notches on the lid to help lock the lid in place. The lid needs to be rotated relative to the base in order to release the latches and permit before the lid can be moved to the open position.

In one aspect, the present disclosure may provide a cover for use in sealing a container comprising a base adapted to be engaged with an upper rim of a container; said base including a wall having a top surface, a bottom surface, an inner surface and an outer surface, wherein the inner surface and outer surface extend between the top surface and bottom surface, and wherein the inner surface bounds and defines an opening through which an upper wall of the container is selectively accessible; and a first sealing member extending upwardly beyond the top surface of the base; and a lid including a top wall; a sidewall circumscribing the top wall; wherein the sidewall has a top surface, a bottom surface, an inner surface and an outer surface; a channel bounded and defined by an interior surface of the lid; wherein an opening to the channel is provided in the bottom surface of the lid's sidewall; wherein the first sealing member of the base is received through the opening in the bottom surface and into the channel of the lid when the lid is moved to a closed position, and the first sealing member is removed from the channel when the lid is moved to an open position; and a passageway is defined between a portion of the lid and a portion of the base when the lid is in the closed position; wherein the passageway is adapted to be in fluid communication with air surrounding an exterior surface of the cover and a space defined between the top wall of the lid and the upper wall of the container.

In another aspect, the present disclosure may provide a method of using a cover on a container holding a liquid, said method comprising engaging a base of a cover on an upper rim of a container that holds a liquid; aligning a channel defined in a bottom surface of a lid of the cover with a first sealing member extending upwardly from the base; pushing the lid downwardly toward the base to engage the first sealing member in the channel; and providing a pathway between a portion of the lid and a portion of the base for gas to escape from a space defined between the lid and an upper surface of the liquid to the air surrounding an exterior surface of the cover.

The method may further comprise grasping a tab on the lid; moving the tab upwardly; disengaging the first sealing member from the channel; moving the lid to an open position relative to the base; and gaining access to the liquid in the container through an opening defined in the base and through an opening defined in an upper wall of the container. The step of engaging the tab on the lid may be preceded by rotating the lid relative to the base and about a longitudinal axis of the container, wherein the longitudinal axis extends between the upper wall of the container and a lower wall of the container; disengaging latches on the base from notches on the lid as the lid is rotated. The method may further comprise receiving at least one latch provided on one of the base and the lid into at least one notch defined in the other of the base and the lid; and preventing the lid from moving from a closed position to an open position until the at least one latch is disengaged from the at least one notch.

In another aspect, the present disclosure may provide in combination a container having a lower wall and a sidewall; said lower wall and sidewall bounding and defining an interior chamber adapted to hold a quantity of carbonated liquid therein; and a sealing cover that is selectively engageable with an upper rim of the sidewall of the container; wherein the sealing cover comprises a base and a lid; wherein the base is engageable with the upper rim of a container; said base including a wall having a top surface, a bottom surface, an inner surface and an outer surface, wherein the inner surface and outer surface extend between the top surface and bottom surface, and wherein the inner surface bounds and defines an opening through which an upper wall of the container is selectively accessible; and a first sealing member extending upwardly beyond the top surface of the base; and the lid includes a top wall; a sidewall circumscribing the top wall; wherein the sidewall has a top surface, a bottom surface, an inner surface and an outer surface; a channel bounded and defined by an interior surface of the lid; wherein an opening to the channel is provided in the bottom surface of the lid's sidewall; wherein the first sealing member of the base is received through the opening in the bottom surface and into the channel of the lid when the lid is moved to a closed position, and the first sealing member is removed from the channel when the lid is moved to an open position; and a passageway is defined between a portion of the lid and a portion of the base when the lid is in the closed position; wherein the passageway is in fluid communication with air surrounding an exterior surface of the cover and a space defined between the top wall of the lid and the upper wall of the container.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
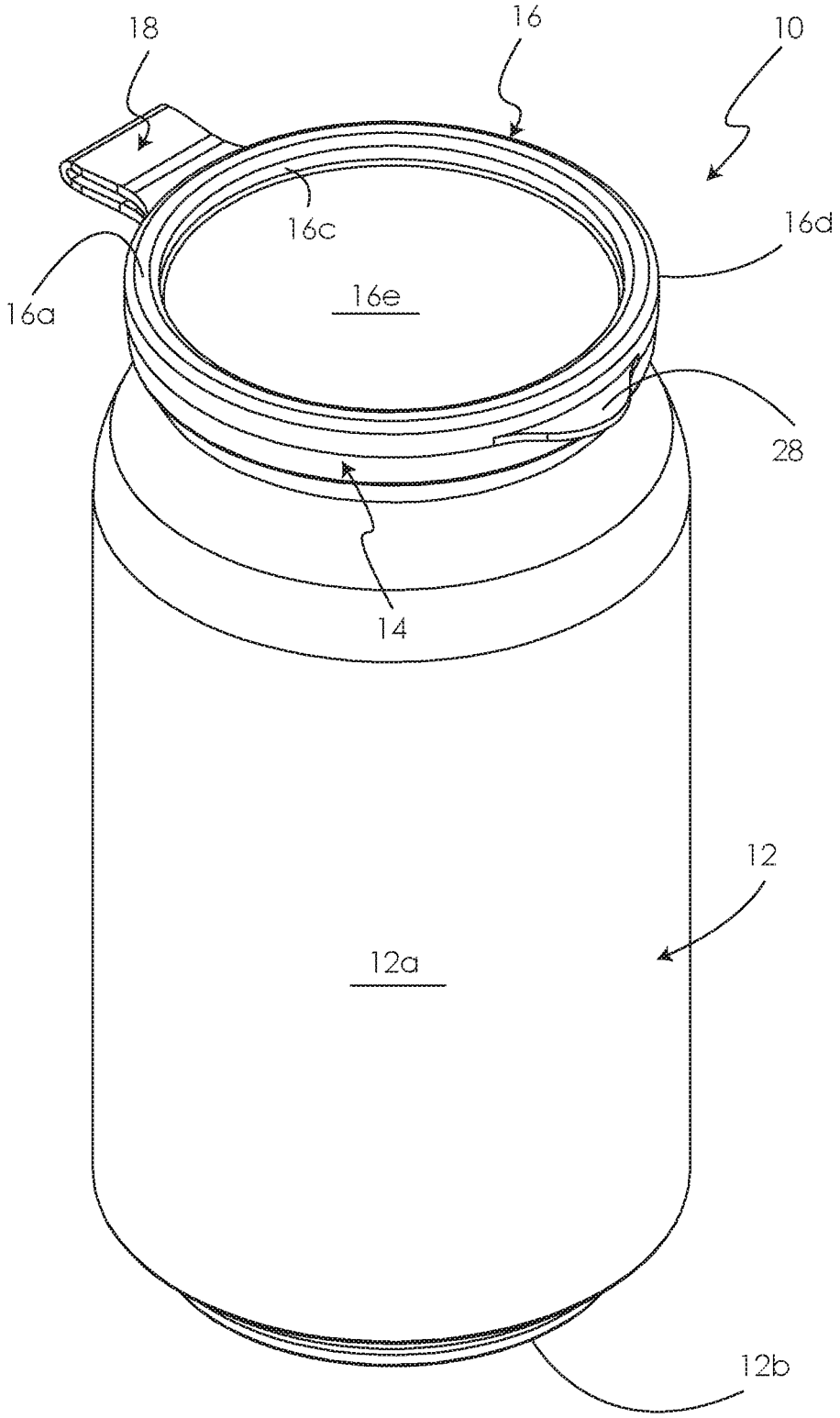
FIG. 1 is a perspective view of a beverage can with a first embodiment of a resealable cover in accordance with an aspect of the present disclosure, and showing the cover in a closed position.
Figure 2:
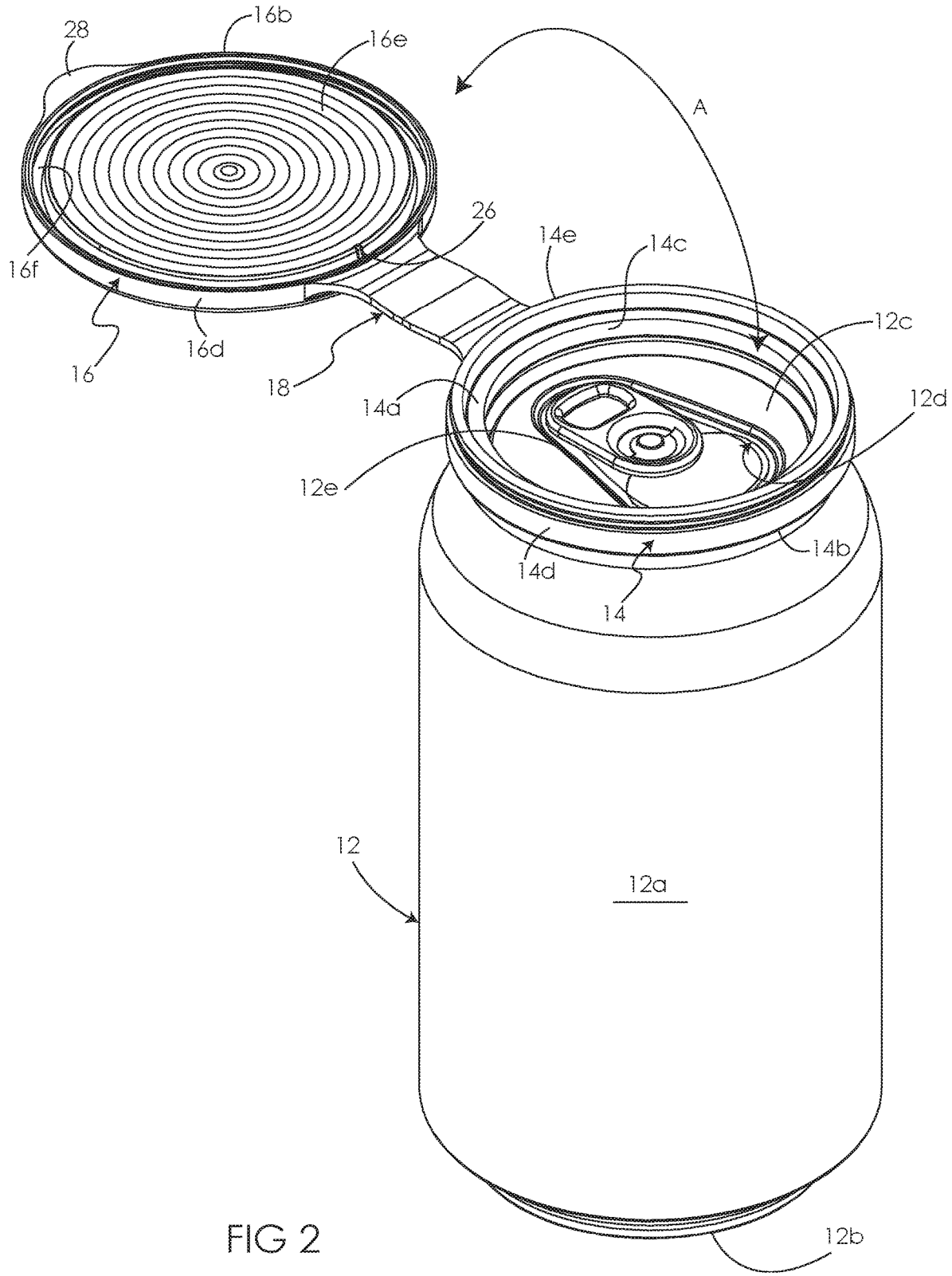
FIG. 2 is a perspective view of the cover shown engaged with the beverage can and moved to an open position.

Referring to FIGS. 1-14 there is shown a first embodiment of a sealing cover in accordance with an aspect of the disclosure, generally indicated at 10. Cover 10 is engaged with a container 12 and is movable between a closed position (FIG. 1) and an open position (FIG. 2). In the closed position, cover 10 prevents access to an interior of container 12 and container 12 is sealed. When cover 10 is moved to the open position, access to the interior of container 12 is permitted. Cover 10 may be a separate component that is purchased by a consumer and is selectively snap-fitted onto container 12. The cover 10 may be fabricated from a material that permits it to be reused. In other words, the consumer may engage cover 10 with a first container and may later remove cover 10 from that first container 12 and engage cover 10 with a second container. In other instances, cover 10 may be engaged with container 12 during production and is not reusable.

Container 12 may be any type of beverage or food can, canister or other holder that defines an interior chamber capable of holding a quantity of liquid, solid, or semi-solid material therein. For the purposes of the following discussion, container 12 may be a beverage container, particularly a metal beverage container that retains a quantity of carbonated liquid therein such as pop or beer. The terms "container", "can", "canister", and "holder" may be used interchangeably herein but should be understood to be exemplary of any type of container made of any substance that retains a quantity of material in an interior chamber.

Figure 8:
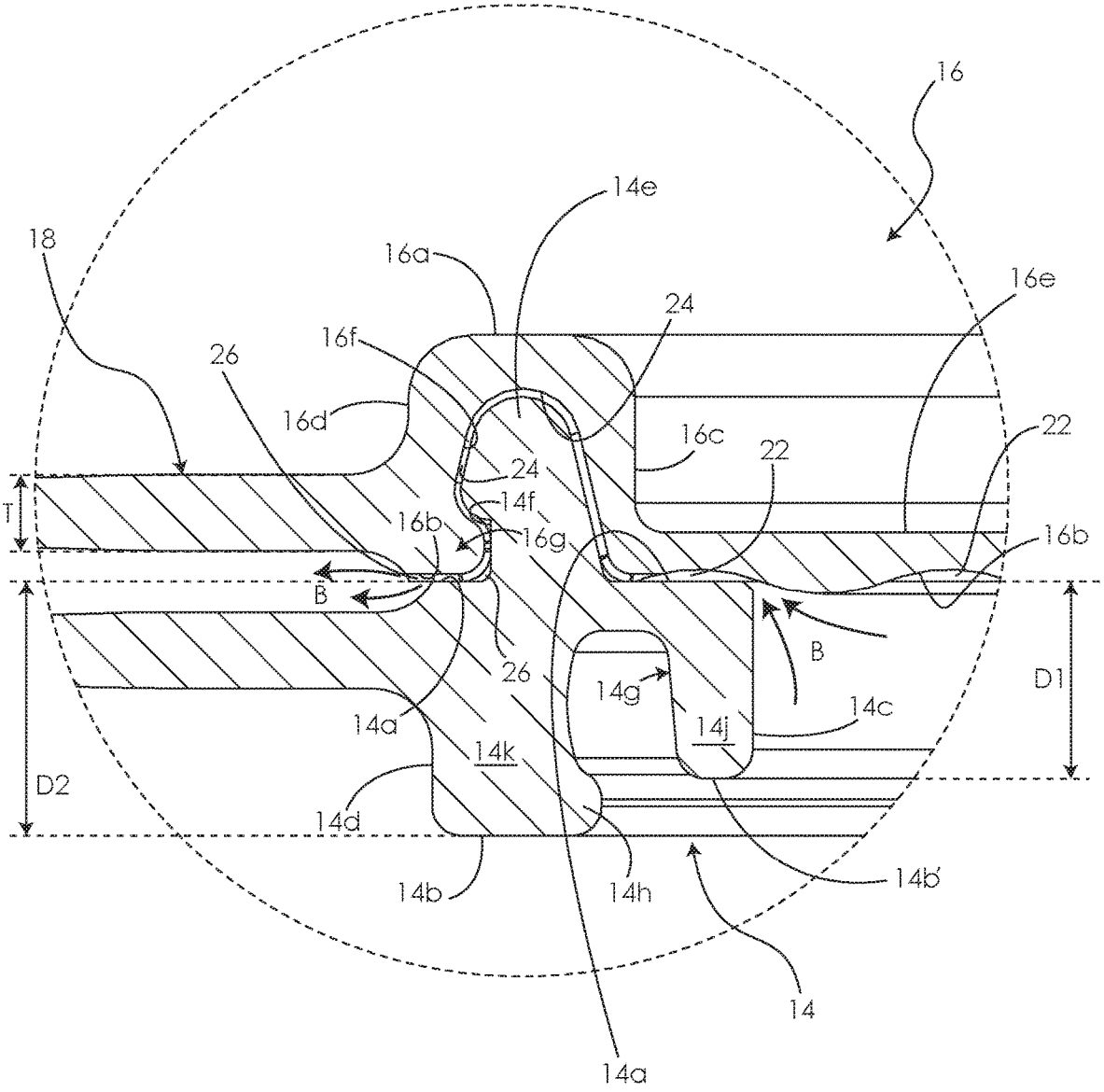
FIG. 8 is an enlargement of a first highlighted region of FIG. 7.
Figure 8A:
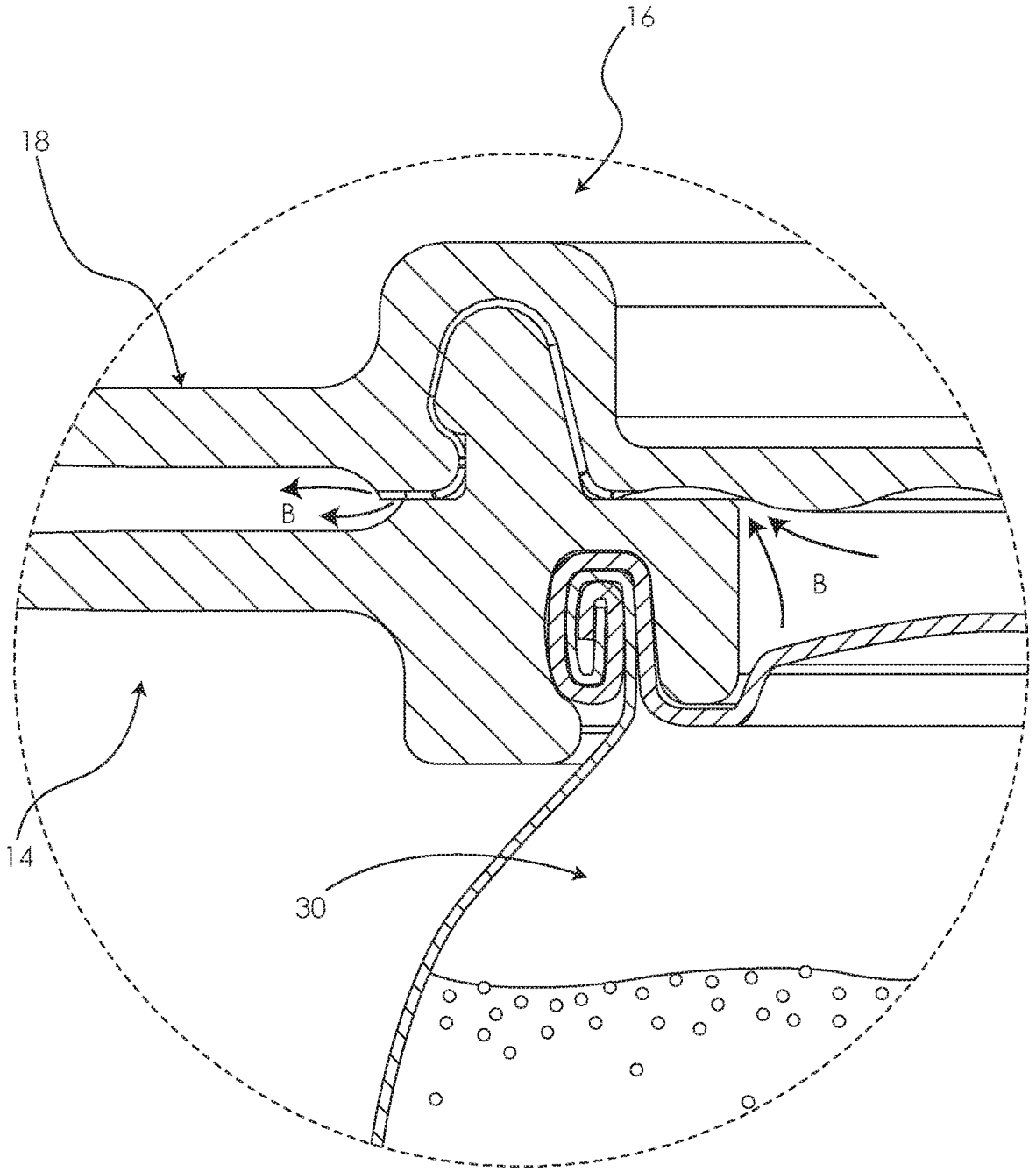
FIG. 8A is an enlargement of the first highlighted region of the cover of FIG. 8 shown engaged on an upper rim of the beverage can.
Figure 9:
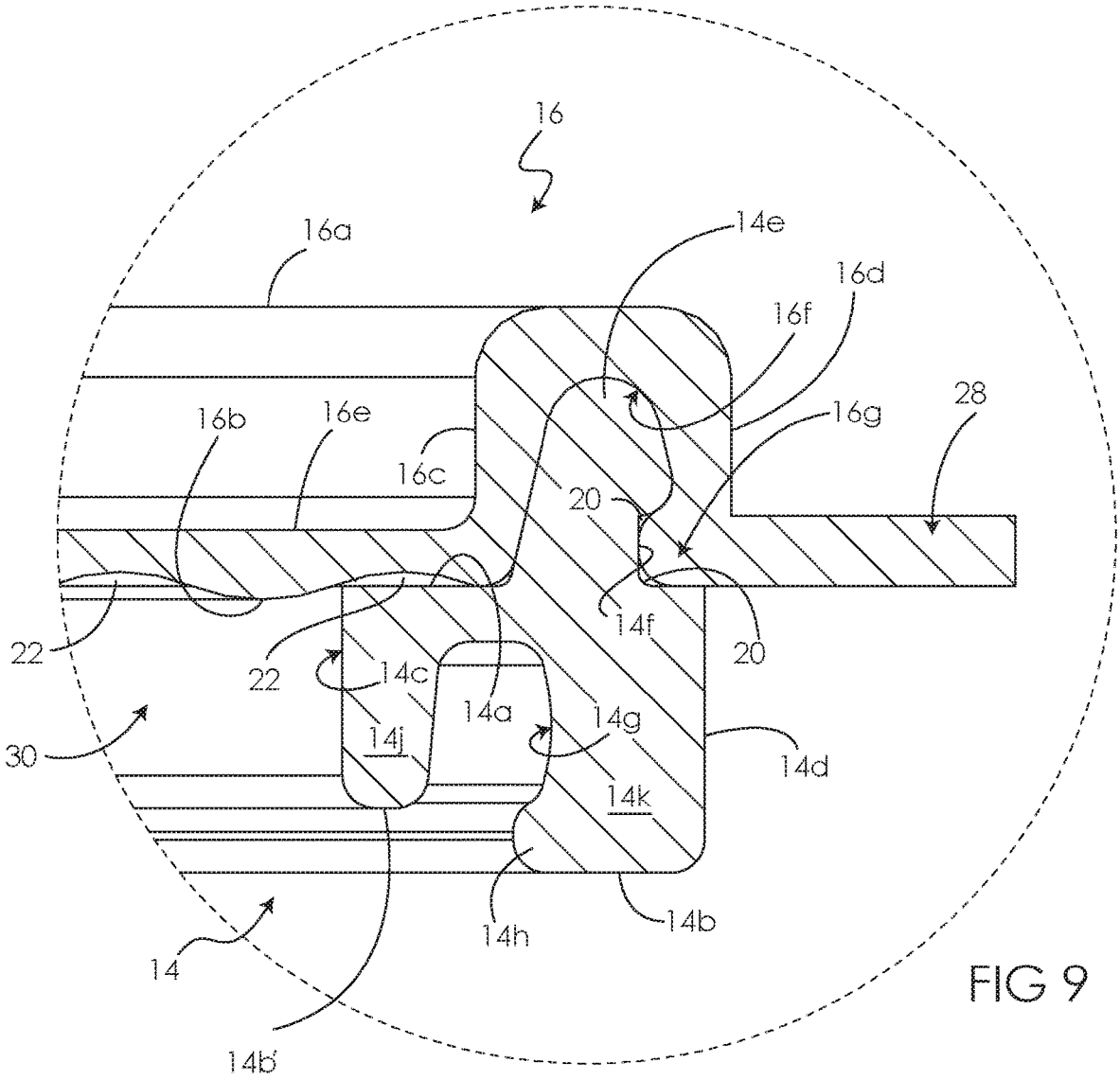
FIG. 9 is an enlargement of a second highlighted region of FIG. 7.
Figure 10:
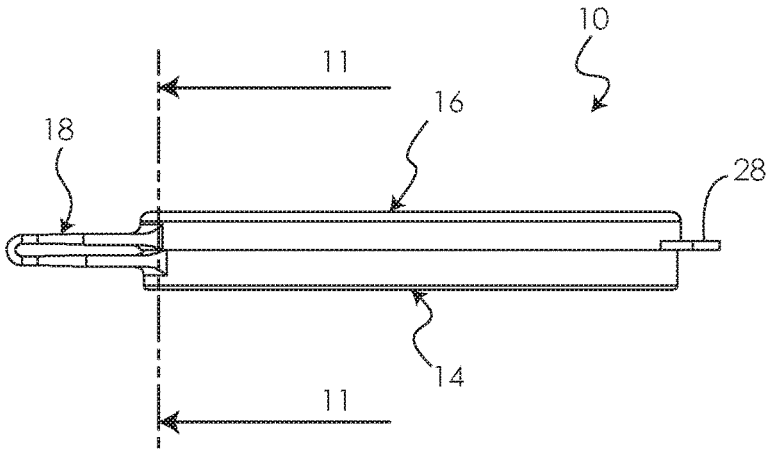
FIG. 10 is a side elevation view of the cover of FIG. 3.
Figure 11:
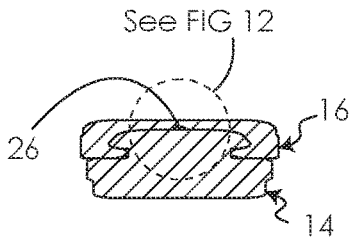
FIG. 11 is a cross-section of the cover taken along line 11-11 of FIG. 10.
Figure 12:
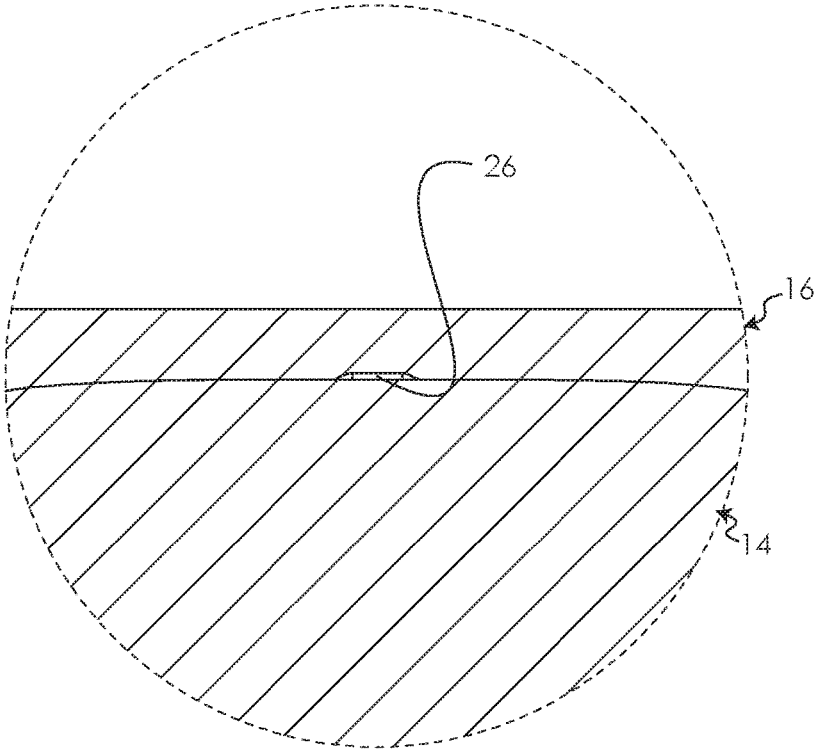
FIG. 12 is an enlargement of the highlighted region of FIG. 11.

FIG. 2 illustrates an exemplary container 12 that includes a sidewall 12*a*, a lower wall 12*b*, and an upper wall 12*c*. Sidewall 12*a*, lower wall 12*b*, and upper wall 12*c* bound and define the interior chamber (not shown) that holds a quantity of carbonated liquid therein. Upper wall 12*c* includes a pull tab 12*e*. When the consumer wishes to access the liquid retained within the interior chamber of the container 12, the pull tab 12*e* is engaged and a section of material of the upper wall 12*c* is thereby removed from upper wall 12*c* thereby creating an opening 12*d*. The liquid retained within the interior chamber may then be accessed through opening 12*d*. If cover 10 is not engaged with container 12, liquid may spill out of container through opening 12*d* if container is knocked over. Furthermore, any carbonation within the liquid may be lost to the surrounding air. Container 12 includes a sealing ring that forms an upper rim 12*f* (FIG. 8A). Cover 10 is engaged with upper rim 12*f* and is moved to an open position (FIG. 2) to permit a user to access opening 12*d*. Cover 10 is moved to a closed position (FIG. 1) to prevent the user from accessing opening 12*d*. If cover 10 is in the open position and container 12 is knocked over, the contents of container 12 may splash or spill out of opening 12*d*. If cover 12 is in the closed position and container 12 is knocked over, the contents of container will not splash out of opening 12*d*. Cover 10 also helps prevent substantial loss of carbonation from the liquid within container 12 when moved to the closed position.

Cover 10 may be fabricated from one or more plastic materials that are appropriate and approved for use in the food industry for coming into direct contact with solid or liquid foods and beverages. Suitable plastic materials for cover 10 may include but are not limited to polypropylene, polyethylene, or polycarbonate.

Figure 13:
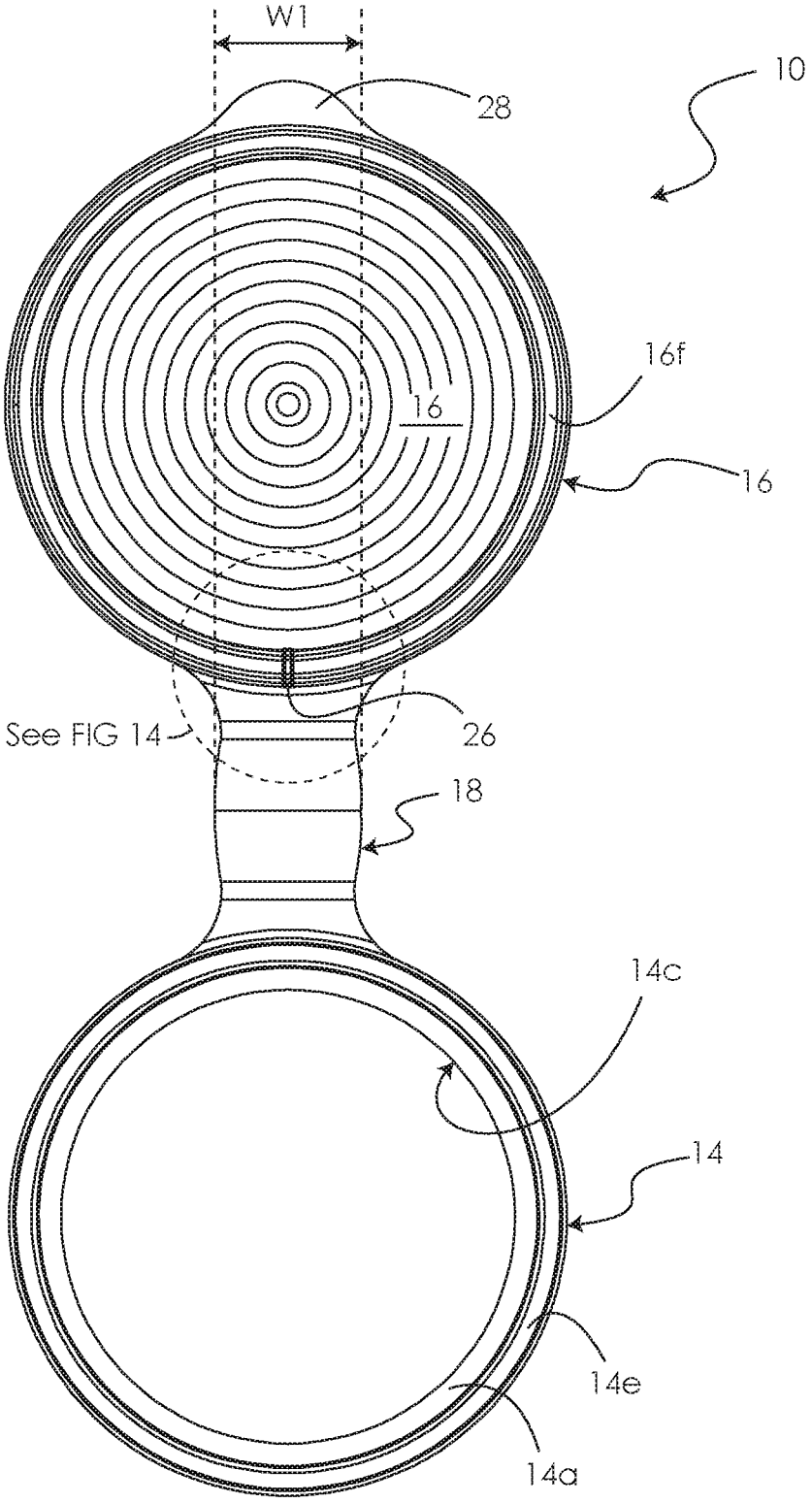
FIG. 13 is a bottom plan view of the cover shown in the open position.
Figure 14:
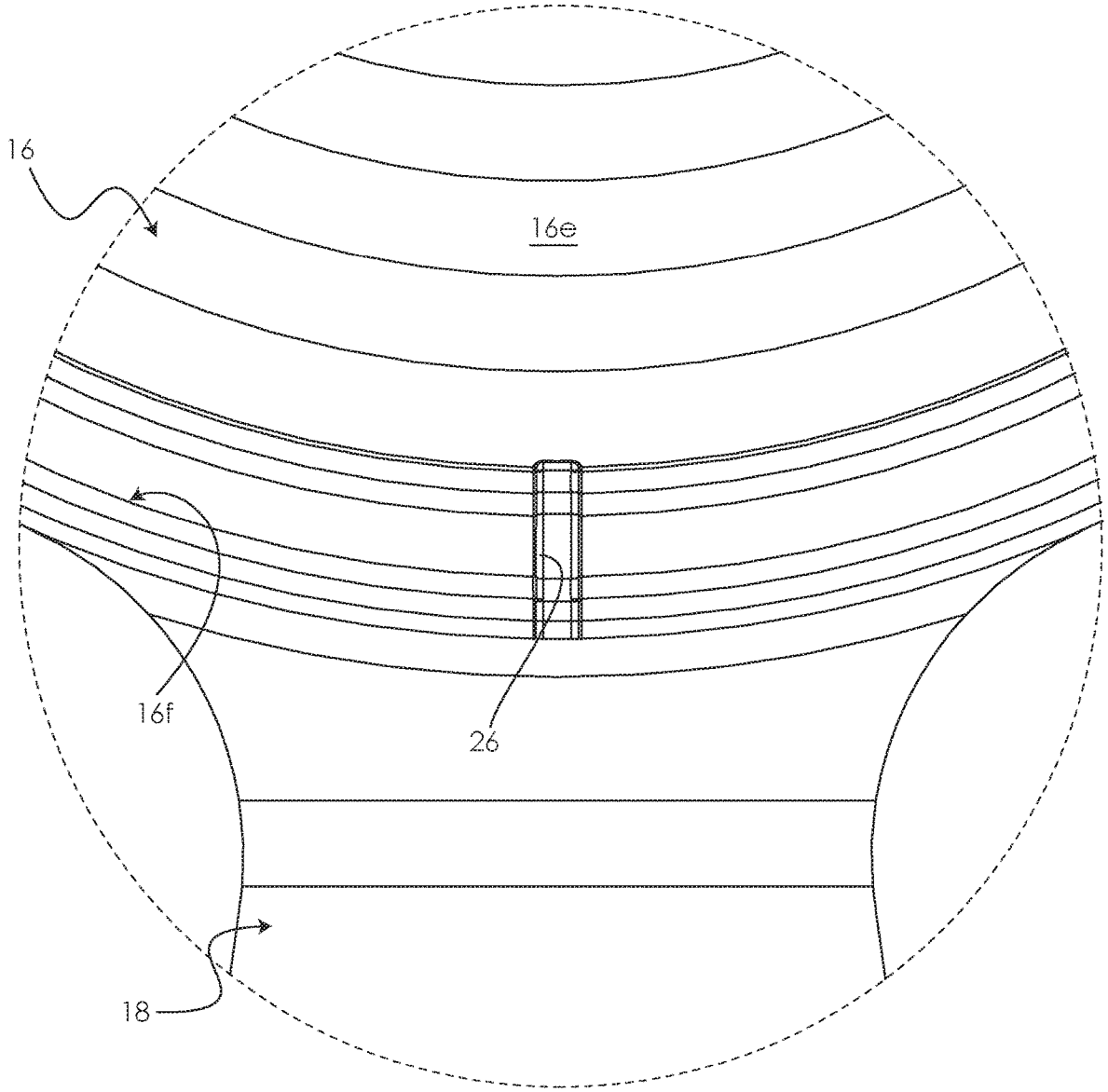
FIG. 14 is an enlargement of the highlighted region of FIG. 13.

Cover 10 includes a base 14 and a lid 16 that are engaged to each other via a flexible (or living) hinge 18. Base 14 is configured to be engaged with upper rim 12*f* of container 12 (FIG. 8A) as will be further described herein. Hinge 18 may be integrally formed with base 14 and lid 16 or may be a separate component that is heat welded or otherwise connected to base 14 and to lid 16. If base 14, lid 16, and hinge 18 are integrally molded, they form a unitary or monolithic component. As shown in FIG. 13, a middle region of hinge 18 may be of a width "W1" that is only marginally narrower than the widths of a first end or a second end of hinge 18, i.e., where the hinge 18 joins base 14 or lid 16. In one example, the width "W1" may be approximately 19 mm. Hinge 18 may be relatively thin (having a thickness "T" as shown in FIG. 8) and is therefore sufficiently flexible to be bent or folded over on itself.

Lid 16 may be movable about hinge 18 and relative to base 14 between the open position (FIG. 1) and the closed position (FIG. 2). The movement between these two positions is indicated in FIG. 2 by arrow "A". It should be noted that when cover 10 is in the closed position, lid 16 is positioned vertically above and aligned with base 14 and hinge 18 is folded back upon itself to form a generally U-shaped member (FIG. 8.) When lid 16 is moved to the open position, i.e., out of vertical alignment with base 14, hinge 18 unfolds and may return back to the position shown in FIG. 2, thereby losing its previous U-shaped configuration. Hinge 18 not only helps keep base 14 and lid 16 engaged with each other but also aids in keeping lid 16 aligned with base 14 so that the two components may be relatively easily positioned for engagement with each other.

It will be understood that instead of a flexible or living hinge 18, cover 10 may be provided with any other type of hinge or connecting mechanism to secure lid 16 and base 14 together, to permit lid 16 to move relative to base, and to prevent lid 16 and base 14 from becoming detached from each other.

Base 14 is configured to be substantially complementary to a top wall of container 12 and lid 16 is configured to be substantially complementary to base 14. The attached figures show container 12 as being generally cylindrical, i.e., having a generally circular cross-sectional shape. Consequently, base 14 is substantially circular in shape when viewed from above and lid 16 is also substantially circular when viewed from above. A longitudinal axis "Y" (FIGS. 5 and 6) extends through a center point of container 12 and a center point of cover 10. Obviously, if the container with which cover is to be engaged has a top wall that is differently configured from being a circular shape, then base 14 and lid 16 will be shaped and sized to be complementary to the top wall of that differently shaped container. Consequently, if the top wall of container is square, rectangular, oval, elliptical, triangular or of any other shape when viewed from above, then base 14 and lid 16 or at least a portion of base 14 and lid 16 will be substantially similarly configured.

Figure 3:
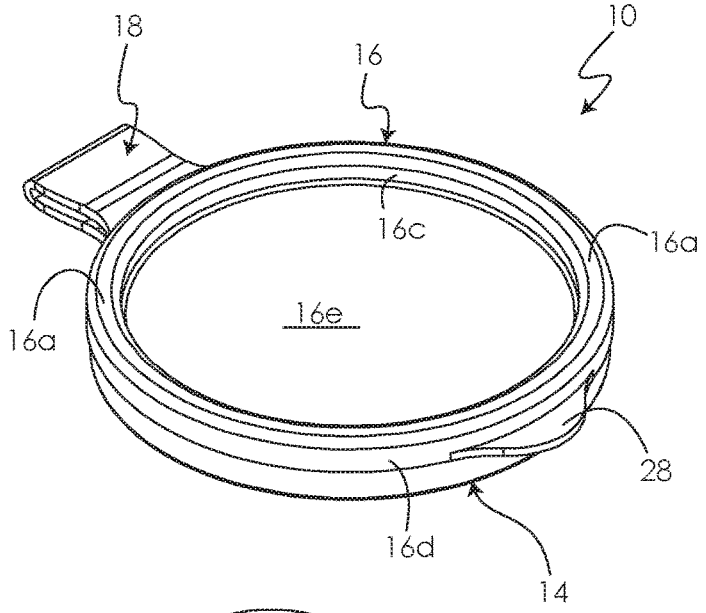
FIG. 3 is a perspective view of the resealable cover in accordance with an aspect of the present disclosure, where the cover is shown on its own and in the closed position.
Figure 4:
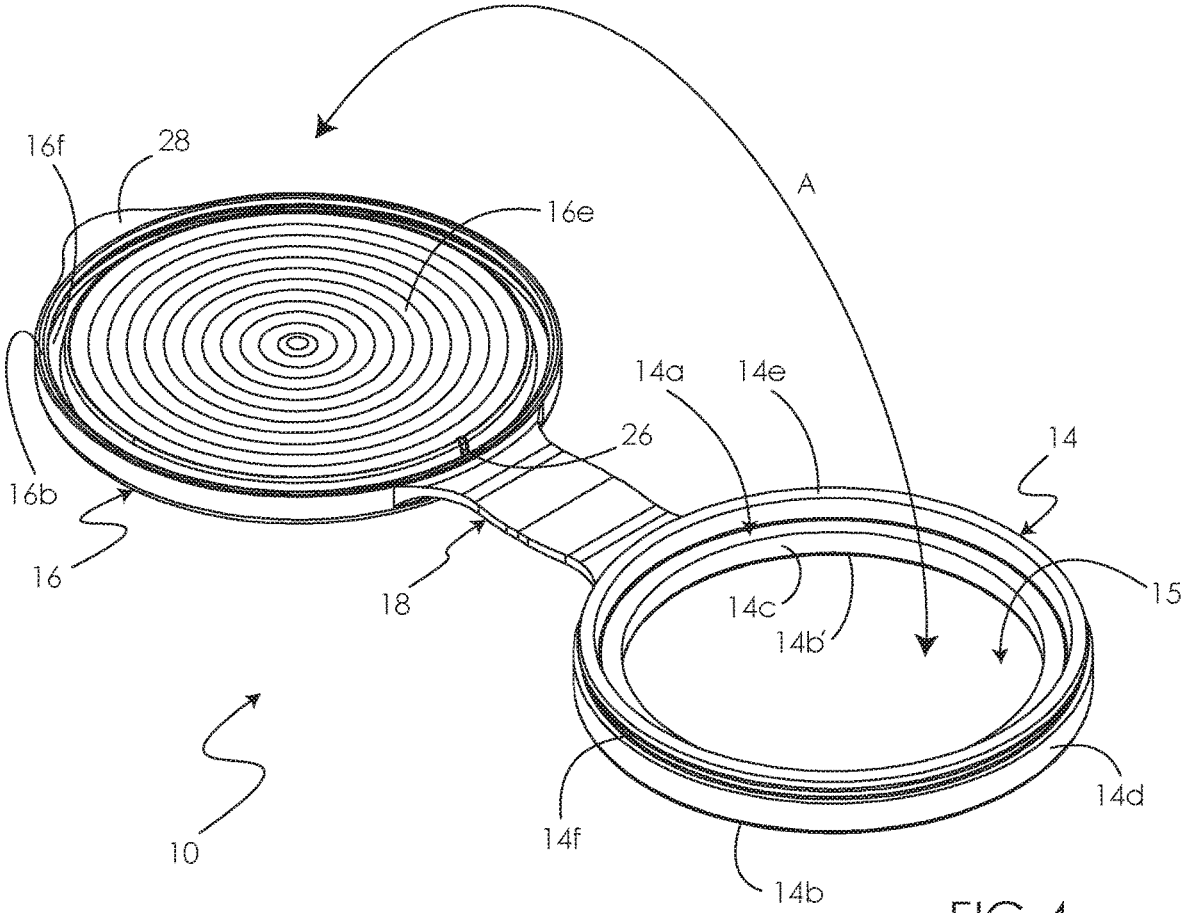
FIG. 4 is a perspective view of the resealable cover of FIG. 3 shown in the open position.
Figure 5:
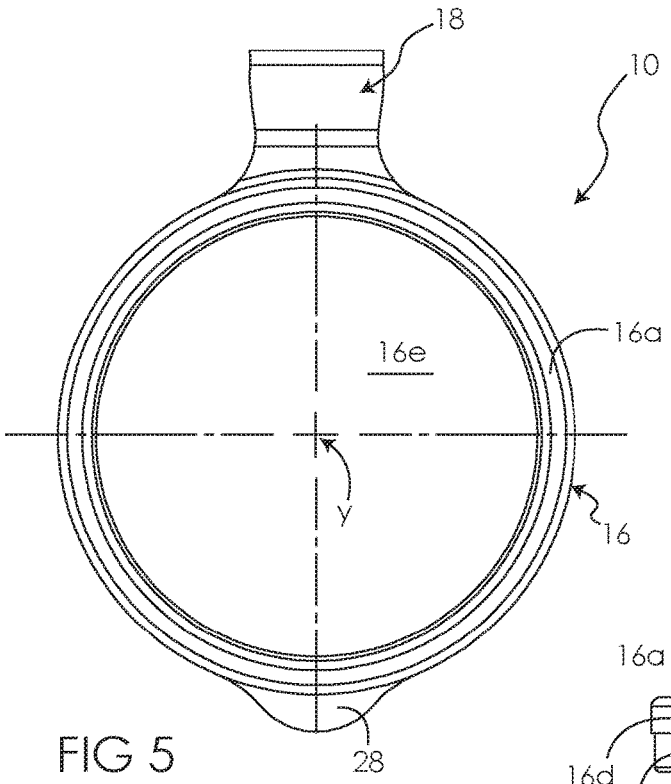
FIG. 5 is a top plan view of the cover in the closed position.
Figure 6:
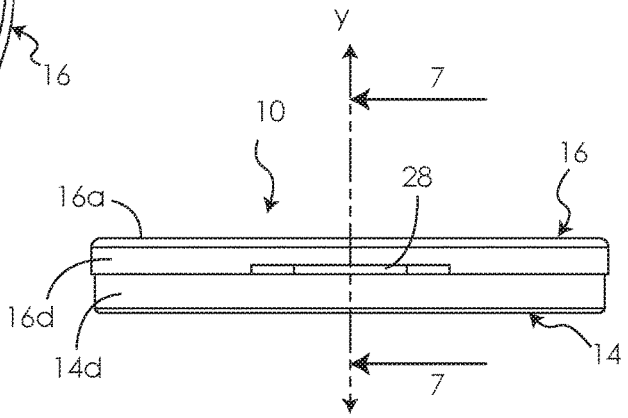
FIG. 6 is a front elevation view thereof.
Figure 7:
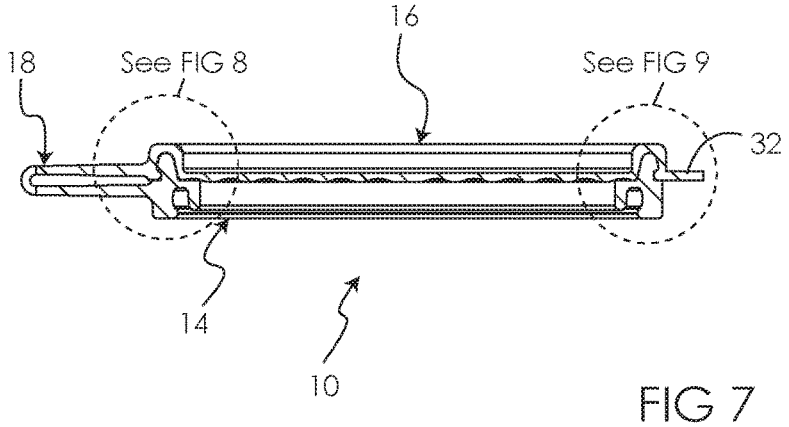
FIG. 7 is a cross-section of the cover taken along line 7-7 of FIG. 6.

Base 14 includes a wall (FIG. 3) that has a top surface 14*a*, a bottom surface 14*b*, an inner surface 14*c*, and an outer surface 14*d*. The wall of base 14 may be an annular wall that is generally circular when viewed from above. Top surface 14*a* is located adjacent lid 16 when lid 16 is moved to the closed position. Bottom surface 14*b* is located so as to be engaged with container 12. Inner surface 14*c* bounds and defines an opening 15 (FIG. 4). Inner surface 14*c* may be considered to generally circumscribe longitudinal axis "Y". When cover 10 is engaged with container 12 and cover 10 is moved to the open position, upper wall 12*c* of container 12 may be accessed through opening 15.

As best seen in FIGS. 8 and 8A, base 14 is provided with a first sealing member in the form of a protrusion 14*e* that extends upwardly and outwardly beyond a top surface 14*a* of the base's wall. Protrusion 14*e* may be a generally U-shaped annular protrusion that may be is spaced a distance radially outwardly from inner surface 14*c* of the lid's wall. Protrusion 14*e* may also be located a distance radially inwardly from outer surface 14*d*. Protrusion 14*e* may be located closer to outer surface 14*d* than to inner surface 14*c*. An annular first groove 14*f* is defined along a region of protrusion 14*e* that is located adjacent and above top surface 14*a*.

Referring still to FIGS. 8 and 8A, a generally U-shaped annular second groove 14*g* is defined in bottom surface 14*b* of base. Second groove 14*g* is located a distance radially outwardly from inner surface 14*c* and is further located a distance radially inwardly from outer surface 14*d*. Second groove 14*g* is located closer to inner surface 14*c* than to outer surface 14*d*. Second groove 14*g* is furthermore located radially inwardly relative to protrusion 14*e*. In other words, second groove 14*g* is radially offset relative to protrusion 14*e*. In one example, first groove 14*f* and second groove 14*g* may be oriented at right angles to each other. First groove 14*f* may be generally oriented at right angles to longitudinal axis "Y" while second groove 14*g* may be generally oriented parallel to longitudinal axis "Y".

Still referring to FIGS. 8 and 8A, an annular projection 14*h* is formed on the base's wall proximate bottom surface 14*b* thereof. In particular, projection 14*h* extends laterally and forwardly toward inner surface 14*c* and partially extends across an opening to second groove 14*g*. The particular configuration of the wall of base 14 is such that a first region 14*j* of the wall located between inner surface 14*c* and second groove 14*g* is shorter than a second region 14*k* of wall located between second groove 14*g* and outer surface 14*d*. First region 14*j* includes a bottom surface 14*b'* that is spaced a distance "D1" (FIG. 8) from top surface 14*a*. Second region 14*k* includes the bottom surface 14*b* that is spaced a distance "D2" from top surface 14*a*, with "D2" being greater than the distance "D1". Projection 14*h* has a height that is generally equivalent to the difference between the distances "D1" and "D2". Projection 14*h* thus extends from bottom surface 14*b* upwardly and terminates generally aligned with bottom surface 14*b'* of first region 14*j*.

Lid 16 includes a sidewall (FIG. 3) that has a top surface 16*a*, a bottom surface 16*b*, an inner surface 16*c*, and an outer surface 16*d*. The lid's sidewall may be an annular sidewall that is complementary in shape to the annular wall of base 14. (Hinge 18 extends radially outwardly from outer surface 14*d* of the base's wall and is joined to outer surface 16*d* of the lid's sidewall.) Bottom surface 16*b* of the sidewall of lid 16 is located adjacent base 14 when lid 16 is moved to the closed position. Lid further includes a top wall 16*e* that is circumscribed by inner surface 14*c*. Inner surface 16*c* of the lid's sidewall may extend upwardly and outwardly beyond an exterior surface of top wall 16*e*. It should be noted that FIG. 3 illustrates cover 10 in the position in which it is molded. This molding position helps to ensure that lid 16 always tends to want to open in a horizontal position and therefore will be located out of the way of a person drinking liquid from container 12 or pouring liquid out of container 12.

As best seen in FIGS. 8 and 8A, a generally U-shaped annular channel 16*f* is defined in bottom surface 16*b*. Channel 16*f* is located a distance radially outwardly from inner surface 16*c* and is further located a distance radially inwardly from outer surface 16*d*. Channel 16*f* is located generally equidistant to inner surface 16*c* and to outer surface 16*d*. Channel 16*f* is furthermore located so as to be aligned with protrusion 14*e* when lid 16 is interlockingly engaged with base 14. In other words, channel 16*f* is radially offset with respect to second groove 14*g*.

Still referring to FIGS. 8 and 8A, an annular projection 16*g* is formed on the lid's sidewall adjacent bottom surface 16*b*. In particular, projection 16*g* extends laterally and forwardly toward inner surface 16*c* of lid 16 and extends at least partially extends across an opening to channel 16*f* defined in bottom surface 16*b*. Projection 16*g* comprises a second sealing member on cover 10, as will be discussed further herein. Projection 16*g* is located so as to be aligned with first groove 14*f* on base 14 when lid 16 is moved to the closed position. First groove 14*f* is sized to interlockingly receive projection 16*g* therein.

As is evident from FIGS. 8 and 8A, while projection 16*g* is designed to be received in first groove 14*f*, the overall configuration of first groove 14*f* and projection 16*g* is such that they are not complementary in size and shape. In particular, projection 16*g* has an exterior profile that differs at least partially from an interior profile of the first groove 14*f*. At least one space is defined where contact is broken between the exterior profile of projection 16*g* and the interior profile of the first groove 14*f* when lid 16 is moved to the closed position. In other words, first groove 14*f* and projection 16*g* are of slightly different shapes and these differences in shape create small spaces 20 between base 14 and lid 16 in the region where projection 16*g* is received in first groove 14*f*. As is illustrated in FIG. 8, first groove 14*f* may be defined by a top surface and a bottom surface of base 14 that are oriented at right angles to a side surface thereof. Projection 16*g* on the other hand may be gently curved and free of right angled corners. As a consequence of this difference in shape of first groove 14*f* and projection 16*g*, one or two small spaces 20 are defined between base 14 and lid 16 when they are interlockingly engaged with each other.

It will be understood that instead of projection 16*g* being generally arcuate in shape and first groove 14*f* including at least one right angled corner, projection 16*g* may, instead, include at least one right angled corner and first groove 14*f* may be arcuate in configuration.

FIGS. 8 and 8A show that bottom surface 16*b* of the sidewall of lid 16 may be sinuous in shape. These shaping of bottom surface 16*b* may not occur around the entire circumference of lid 16 but instead may be located on portions of bottom surface 16*b* that are located closest to hinge 18. When lid 16 is moved to the closed position and is interlockingly engaged with base 14 by receiving protrusion 14*e* of base 14 in channel 16*f* of lid 16, the sinuous bottom surface 16*b* of lid 16 periodically contacts the generally flat top surface 14*a* of base 14. At least one air pocket 22 is formed wherever contact is broken between bottom surface 16*b* of lid and top surface 14*a* of base. Each air pocket 22 is bounded and defined by top surface 14*a* of base 14 and a region of the sinuous bottom surface 16*b* of lid 16. The attached figures show a plurality of small air pockets 22 formed between the engaged base 14 and lid 16.

Annular channel 16*f* on lid 16 is configured to be slightly larger than the annular protrusion 14*e* on base 14. As a consequence of this difference in size, a gap 24 (FIG. 8) may be defined between an exterior surface of protrusion 14*e* and the interior surface of lid 16 that defines channel 16*f*. Gap 24 may be in fluid communication with air pockets 22 and spaces 20.

A small trough 26 (FIGS. 4, 12 and 13) is defined in bottom surface 16*b* of the sidewall of lid 16. In particular, trough 26 is located where lid 16 joins hinge 18. The trough 26 may only be about 0.005 inches deep and about 0.014 inches wide. When lid 16 is engaged with base 14, trough 26 is placed in fluid communication with spaces 20, gap 24 and air pockets 22, and thereby with the space 30 (FIG. 9) defined between an interior surface of lid 16 and a topmost surface of a liquid retained within container 12. The trough 26, spaces 20, gap 24, and air pockets 22 create a serpentine passageway or bypass vent through which pressurized gas may escape from space 30. If the liquid retained within container 12 is carbonated, some of the carbonation may be released into the air above the liquid and under the closed lid 16. As more carbonation escapes from the liquid, pressure may build under lid 16. The fluid communication between the trough 26, spaces 20, gap 24, and air pockets 22 provides a pathway through which pressurized gas may escape, thereby reducing the possibility that the released carbonation will cause lid 16 to disengage from base 14. The release of pressurized gas from space 30 under lid 16 through the serpentine pathway is indicated by the arrows "B" shown in FIGS. 8 and 8A. It should be noted that the pathway passes over the very highest point of base 14 (i.e., over protrusion 14*e*) and outgasses between portions of the folded hinge 18. The pathway is not of a size that will readily permit liquid to escape therethrough if container 12 is tipped over, unless that liquid is under pressure. The serpentine nature of this pathway also makes liquid leakage therethrough less likely.

Cover 10 is made from plastic and may be reused multiple times. Cover 10 may readily be removed from one container and be engaged with another. It should be noted that the various component parts that make up the serpentine pathway when lid 16 is interlockingly engaged with base 14 are exposed when lid 16 is separated from base 14. As a consequence, any liquid from the container that may dry onto these component parts is able to be washed off the component parts between uses of cover 10. Consequently, the pathway does not tend to become clogged up over time.

A tab 28 extends radially outwardly from the outer surface 16*d* of the sidewall of lid 16. Tab 28 may be used to lift lid 16 out of engagement with base 14. It will be understood that more than one tab 28 may be provided on lid 16 for this purpose.

In use, base 14 may be engaged with container 12 by positioning annular second groove 14*g* above and in alignment with upper rim 12*f* and pushing downwardly to cause upper rim 12*f* to be received within second groove 14*g* and frictionally engaged therewith. In order to access the contents of container 12, the user will remove pull tab 12*e* and will drink the contents through opening 12*d*.

When it is desired to close off access to opening 12*d*, cover 10 has to be moved to the closed position. In order to close cover 10, lid 16 is moved relative to base 14 about hinge 18 and is positioned vertically above and aligned with base 14. Lid 16 is then snap-fittingly pushed downwardly toward base 14 and is thereby engaged with base 14. In particular, channel 16*f* on lid 16 is aligned with protrusion 14*e* on base 14. Lid 16 is pushed downwardly toward base 14 to cause protrusion 14*e* to be received within channel 16*f*. Protrusion 14*e* may be snugly received in channel 16*f* of lid 16 and is retained therein by friction. FIG. 8A shows that when lid 16 is pushed downwardly into contact with base 14, projection 16*g* of lid 16 is also received into first groove 14*f* of base 14. Lid 16 and base 14 are therefore secured to each other by protrusion 14*e* being frictionally retained within channel 16*f* and by projection 16*g* being retained within first groove 14*f*. Lid 16 and base 14 may subsequently be progressively sealed by the user running their finger around the top surface 16*a* of lid 16 while pushing downwardly toward base 14.

Carbonation from the contents of container 12 may tend to build up in the space between the top surface of the liquid contents and the interior surface of top wall 16*e*. As the pressure builds in this space, some of the gas will find its way through the serpentine pathway created by air pockets 22, spaces 20, and trough 26 and will escape into the air surrounding container 12. This will tend to reduce the pressure in the space between the top surface of the liquid in container 12 and the interior surface of top wall 16*e*. If container 12 is knocked over at this point, very little liquid will tend to escape through the serpentine pathway. Additionally, because the pressure under lid 16 is able to be substantially continuously relieved and because of the two engagement regions of lid 16 with base 14 there is less tendency for the lid 16 to be "blown" out of engagement with base 14 if container 12 is knocked over. The two engagement regions are the receipt of protrusion 14*e* in channel 16*f* and the receipt of projection 16*g* in first groove 14*f*. Lid 16 may become slightly disengaged from base 14 if container 12 is knocked over and may allow a little liquid to flow out of the regions where lid 16 has disengaged from base 14 but the quantity of liquid tends to be kept to a minimum.

When a user decides they wish to access the liquid within container 12, the user may grasp tab 28 on lid 16; moving tab 28 upwardly and in a direction away from base 14. This motion causes the first sealing member (i.e., protrusion 14*e*) to disengage from channel 16*f*. The motion is continued until lid 16 is moved to the open position relative to the base shown in FIG. 2. At this point, the user is able to gain access to the liquid in container 12 through opening 15 defined in base 14 and through opening 12*d* defined in upper wall 12*c* of container 12. The liquid may be poured out of opening 12*d* of container 12 or the user may drink the liquid from container 12. Lid 16 may be pushed back into engagement with base 14 as desired. It will be understood that when lid 16 is moved to the open position, projection 16*g* (i.e., the second sealing member) is removed from first groove 14*f* of base 14 substantially simultaneously with protrusion 14*e* being withdrawn from channel 16*f*.

Referring to FIGS. 15 to 29, a second embodiment of a cover in accordance with the present disclosure is illustrated. The second embodiment of the cover is indicated by the reference number 110. Cover 110 includes a child-safety design. This means there are two actions required for opening cover 110 but only one action required to close and seal cover. Cover 110 may be utilized for preventing a young child from gaining access to an alcoholic beverage in container 12. Furthermore, as new drug laws are passed and the beverage industry is permitted to add tetrahydrocannabinols (THC) into some of their products, cover 110 may be able to prevent a child from accessing THC-laced beverages within container 112.

Cover 110 is substantially identical in structure and function to cover 10 except for two regions. Cover 110 includes a base 114 and a lid 116 that are engaged with each other via a hinge 118. Base 114 is substantially identical in structure and function to base 14 and lid 116 is substantially identical in structure and function to lid 16. The only difference between base 114 and base 14 is that base 114 includes at least one latch 117 that extends radially outwardly from outer surface 114*d* of the sidewall 114 of base 114. Two latches 117 are illustrated extending outwardly from outer surface 114*d* in locations that fall either side of second tab 134. There may be more than two latches 117 provided on base 114.

Figure 29:
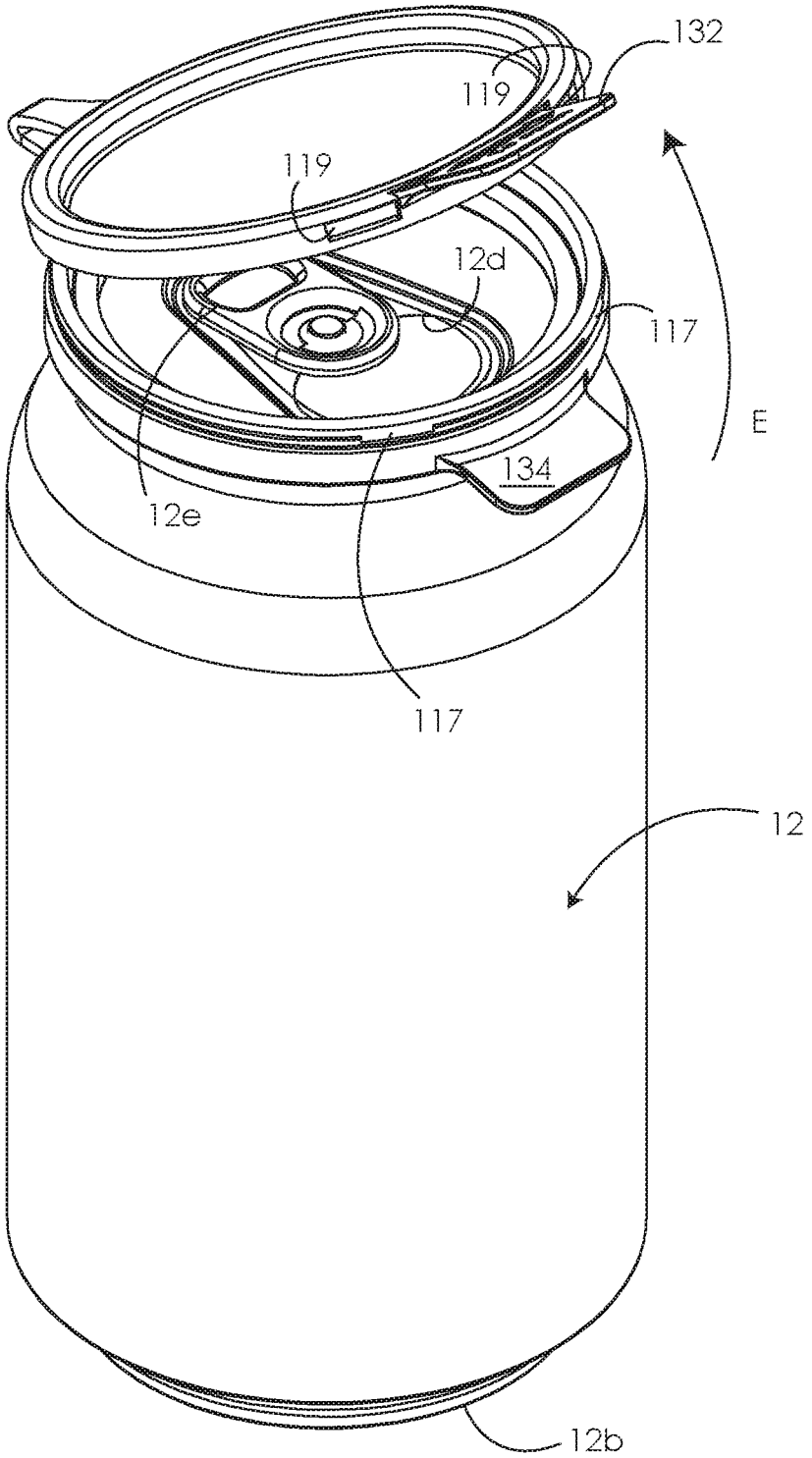
FIG. 29 is a perspective view of the cover engaged with the container and moved to the open position, and further showing one of the two latches on the base.

The only difference between lid 16 and lid 116 is that lid 116 defines at least one notch 119 proximate first tab 132. As illustrated in FIG. 29, lid 116 may define two notches 119 that are defined in the outer surface 116*d* of the sidewall 116 of lid 116. It will be understood that more than two notches 119 may be provided on lid 116. It will further be understood that the number of latches 117 and notches 119 may be complementary.

Notches 119 extend from the interior surface of the sidewall 116 to the outer surface 116*d* thereof and are located on either side of first tab 132. In particular, notches 119 are located so as to be selectively aligned with latches 117 on base 114.

In other examples, the latches may be provided on the inner surface of the sidewall of lid 116 and the complementary notches may be defined in the wall of base 114.

Figure 25:
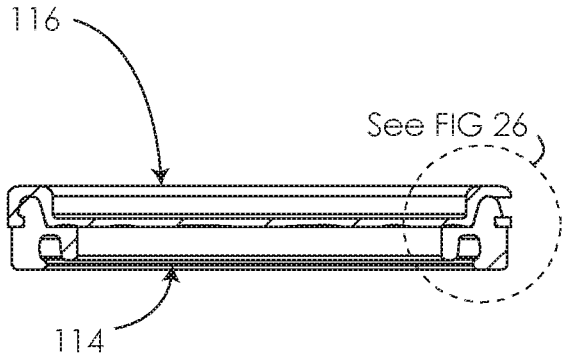
FIG. 25 is a cross-section of the cover taken along line 25-25 of FIG. 19 showing the cover in a position where the latch is engaged with the notch.
Figure 26:
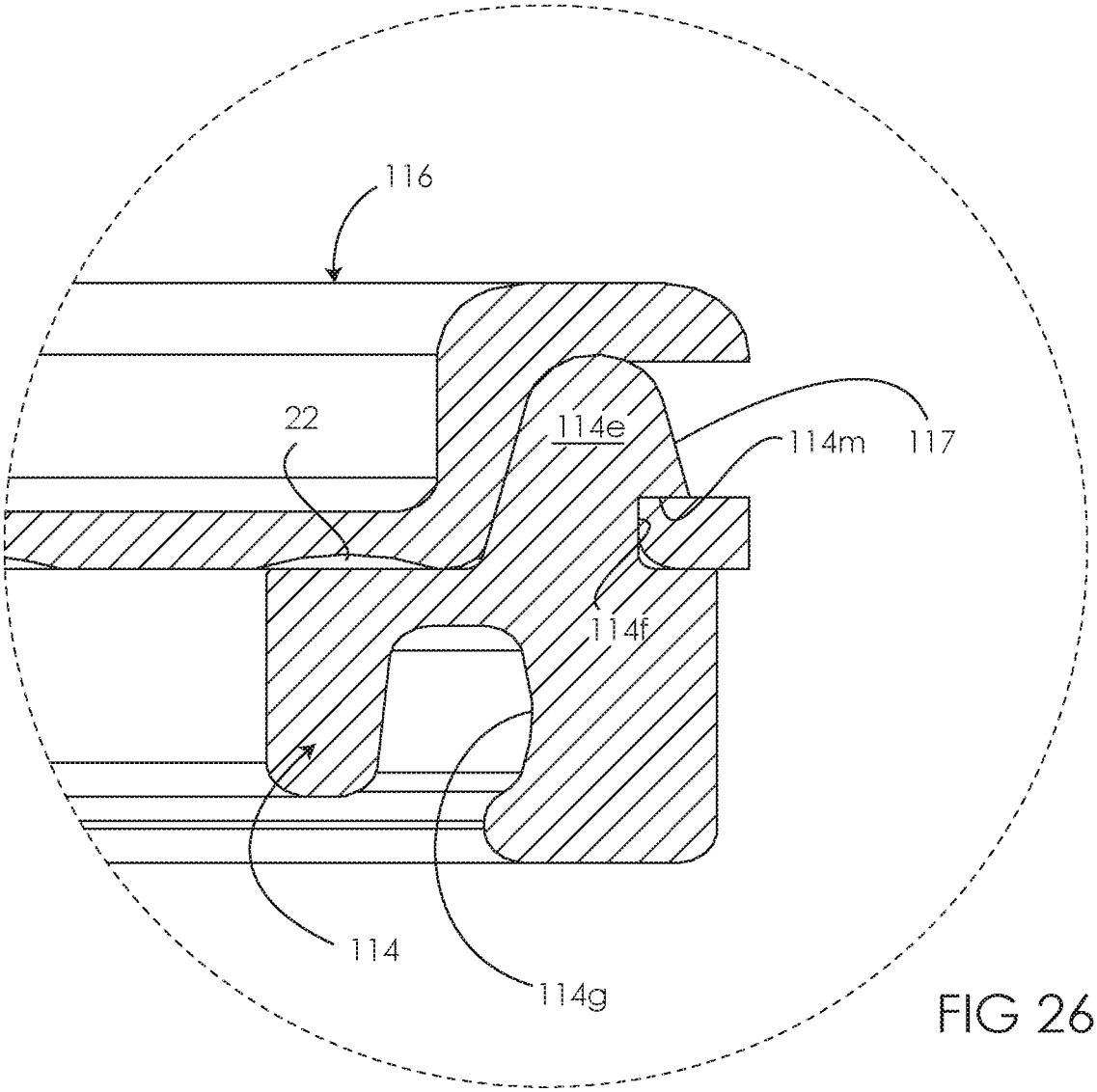
FIG. 26 is an enlargement of the highlighted region of FIG. 25.

When lid 116 is moved to the closed position relative to base 114, at least one latch provided on one of the base 114 and the lid 116 is received into at least one notch 119 defined in the other of the base 114 and the lid 116. The engagement between the lid 116 and base 114 is secured by the engagement between the at least one latch 117 and the at least one notch 119. This engagement is shown in FIG. 26. The lid 116 is substantially prevented from being moved from the closed position to the open position because the at least one latch 117 contacts a shoulder 114*m* on protrusion 114*e*. In order to move lid 116 to the open position, lid 116 is rotated relative to base 114 to disengage the at least one latch 117 from the at least one notch 119. FIG. 25 shows lid 116 in a position where it may be moved to the open position.

Figure 21:
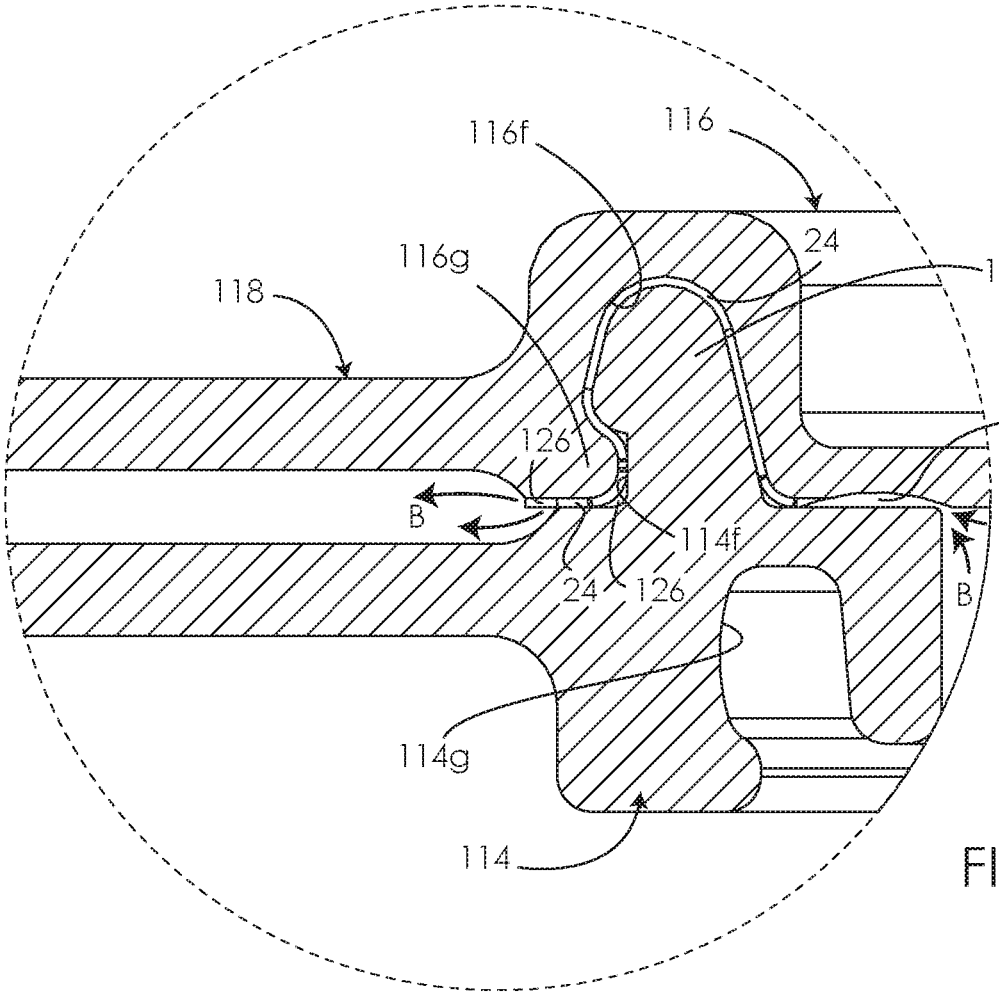
FIG. 21 is an enlargement of a first highlighted region of FIG. 20.

All other components of base 114 and lid 116 are substantially identical to base 14 and lid 16 and will therefore not be further described herein. It should be noted that cover 110 includes a trough 126 (FIG. 21) that is in substantially the same location as trough 26 of cover 10 and forms part of a serpentine pathway that includes spaces 20, air pockets 22, gap 24 and trough 26. This serpentine pathway, similar to the serpentine pathway in cover 10, permits outgassing from the space between the inner surface of lid 116 and a top surface of a liquid held within container 12. This outgassing or release of pressure from under cover 110 is illustrated in FIG. 21 by the arrows "B".

Figure 22:
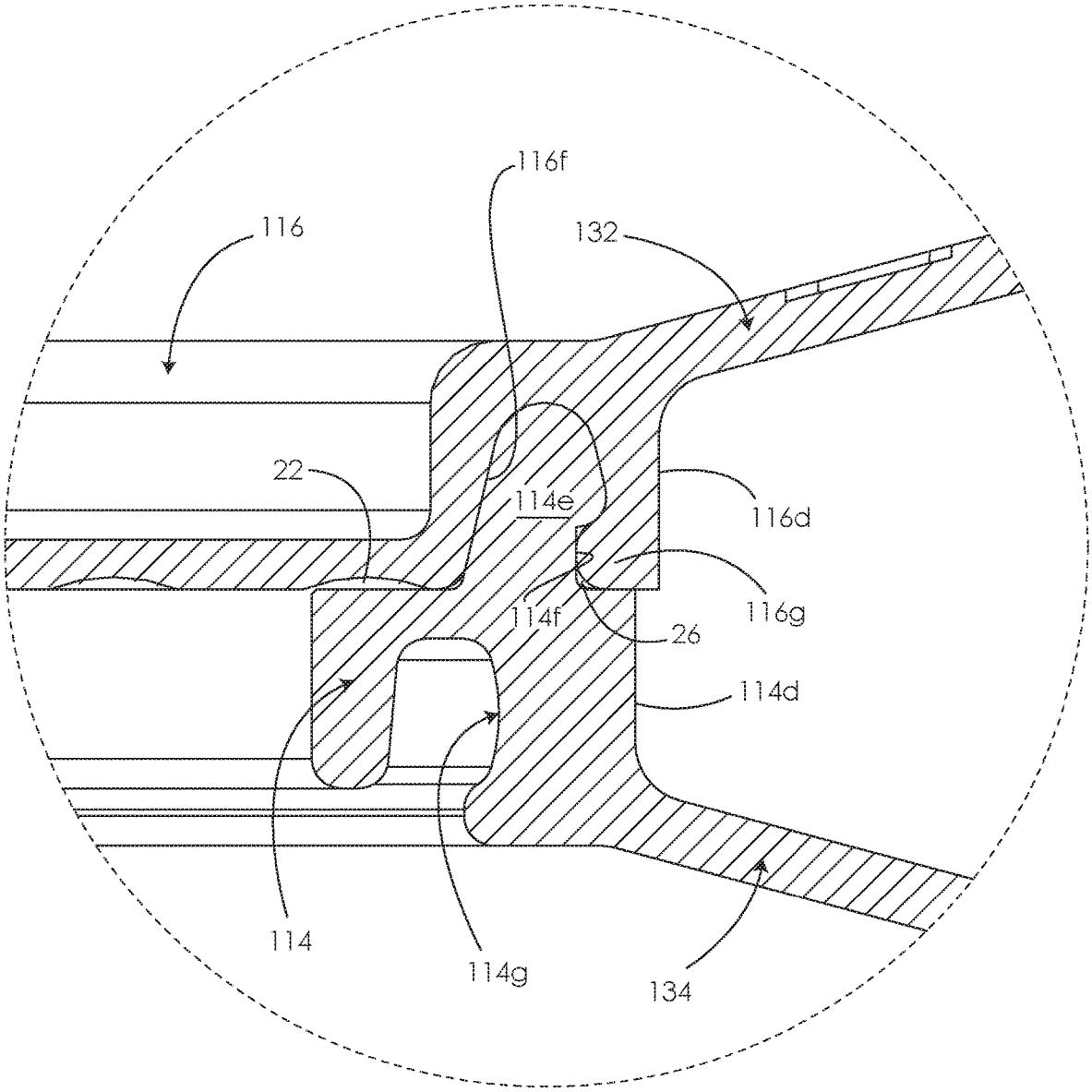
FIG. 22 is an enlargement of a second highlighted region of FIG. 20.
Figure 23:
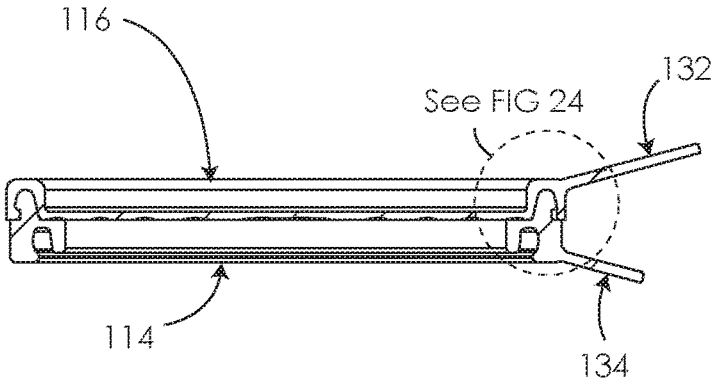
FIG. 23 is a cross-section of the cover taken along line 23-23 of FIG. 19 showing the cover in a position where the latch has been disengaged from the notch.
Figure 24:
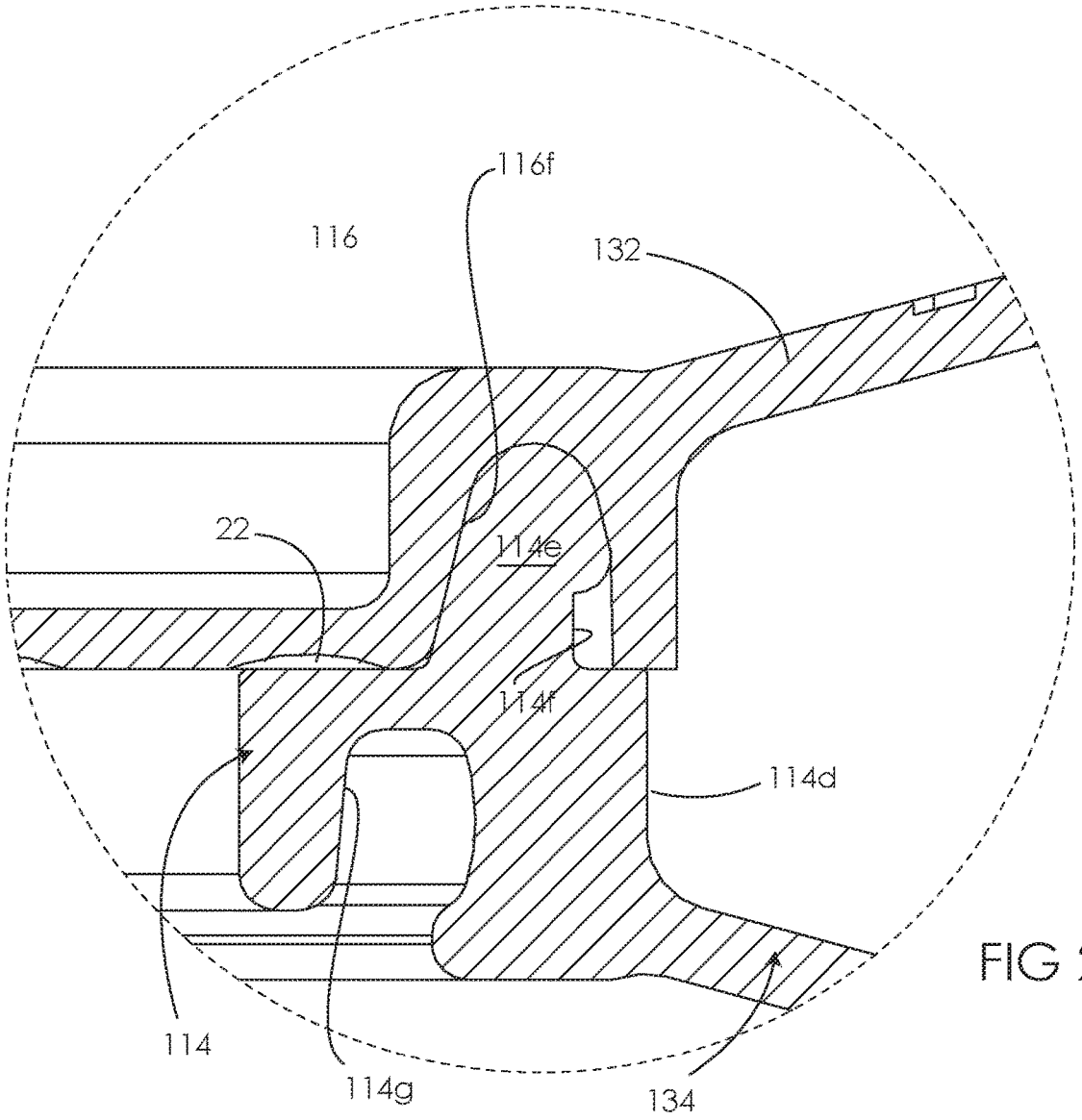
FIG. 24 is an enlargement of the highlighted region of FIG. 23.

Hinge 118 differs from hinge 18 in a number of ways. Firstly, the narrowest width "W2" (FIG. 17) of hinge 118 is substantially smaller than the width "W1" of hinge 18. Even the widest width "W3" of hinge 118 is substantially smaller than the width "W1" of hinge 18. In one example, the width "W2" may be approximately 4 mm and the width "W3" may be approximately 10 mm. The smaller width "W2" enables lid 116 to rotate to a certain degree relative to base 114. When lid 116 is rotated, hinge 118 will tend to twist slightly as can be seen in FIG. 22.

Figure 18:
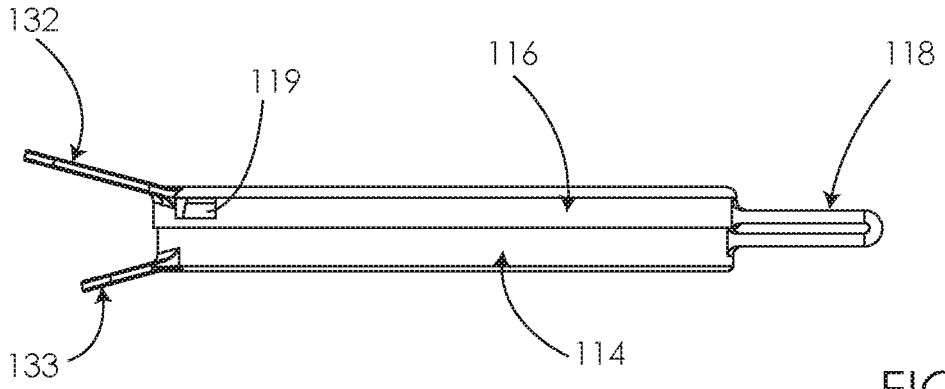
FIG. 18 is a side elevation view thereof.
Figure 19:
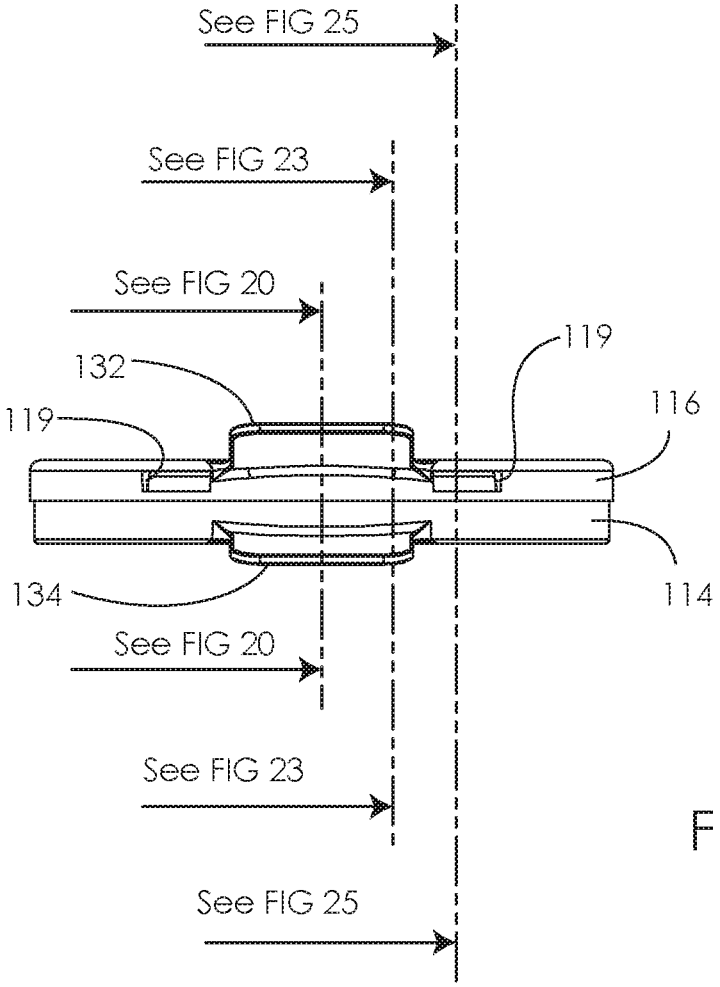
FIG. 19 is a front elevation view thereof.
Figure 20:
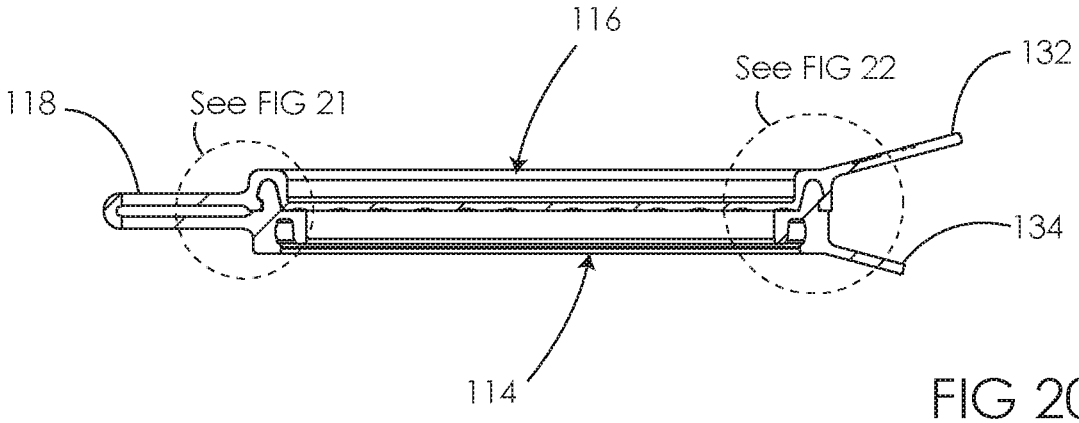
FIG. 20 is a cross-section of the cover taken along line 20-20 of FIG. 15.

Cover 110 also differs from cover 10 in that instead of having a single tab 28 extending outwardly from lid 16, cover 110 is provided with a first tab 132 and a second tab 133. First tab 132 extends outwardly from a region of lid 116 opposite hinge 118. Second tab 133 extends outwardly from a region of base 114 opposite hinge 118. As best seen in FIG. 18, first tab 132 angles upwardly away from the horizontal and second tab 133 angles downwardly away from the horizontal. As a result, first tab 132 and second tab 133 flare outwardly away from each other. (Tab 28 on cover 10 is oriented substantially parallel to the horizontal, as may be seen in FIG. 10.) First tab 132 is longer than second tab 134. In other words, first tab 132 extends further outwardly away from a sidewall of lid 116 than second tab extends outwardly from a sidewall of base 114.

Figure 17:
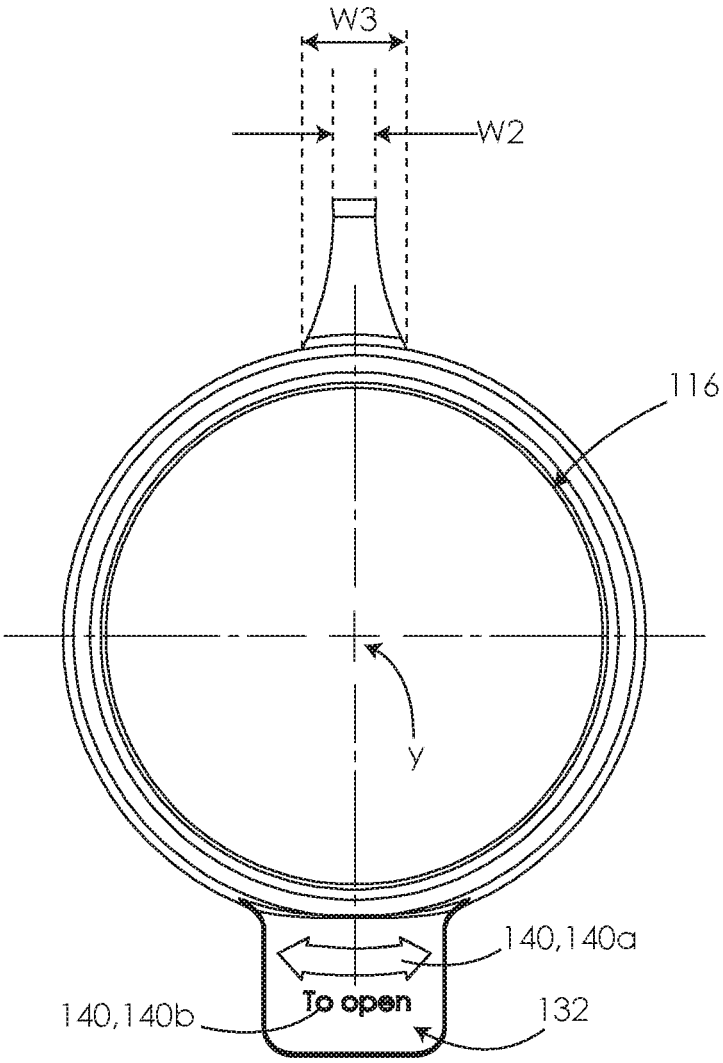
FIG. 17 is a top plan view of the cover in the closed position.

As best seen in FIG. 17, first tab 132 includes indicia 140 thereon. The indicia 140 may include a graphic image of a double-headed arrow 140*a* and words 140*b*. In particular, indicia 140*a*, 140*a* indicate to a user that they should rotate lid 116 in one of a first direction or a second direction in order to cause disengagement of lid 116 from base 114. In order to open cover 110, the user must first rotate lid 116 in either of the first direction or the second direction through from about ten degrees up to about fifteen degrees in order to release lid 116 to be opened. The first tab 132 may then be pushed upwardly in order to lift lid 116 out of engagement with base 114.

Cover 110 is used in the following way. Base 114 may be engaged with container 12 by positioning annular groove 114*g* (FIG. 20) above and in alignment with upper rim 12*f* of container 12. Base 114 is pushed downwardly to cause upper rim 12*f* of container to be received within groove 114*g* and become frictionally engaged therewith. In order to access the contents of container 12, the user will remove pull tab 12*e* and will drink the contents through opening 12*d*.

When it is desired to close off access to opening 12*d*, cover 110 has to be moved to the closed position. In order to close cover 110, lid 116 is moved relative to base 114 about hinge 118 and is positioned vertically above and aligned with base 114. Lid 116 is then pushed downwardly toward base 114 and thereby becomes engaged with base 114. In particular, groove 116*f* on lid 116 is aligned with protrusion 114*e* on base 114. Lid 116 is pushed downwardly toward base 114 to cause protrusion 114*e* to become received within groove 116*f*. Protrusion 114*e* may be snugly received in groove 116*f* of lid 116 and is retained therein by friction. Projection 116*g* of lid 116 is also received into groove 114*f* of base 114. Lid 116 and base 114 are consequently secured to each other by protrusion 114*e* being frictionally retained within groove 116*f* and by projection 116*g* being retained within groove 114*f*. Additionally, when lid 116 is pushed downwardly into sealing engagement with base 114, latches 117 on base 114 become engaged in notches 119 on lid 116. The engagement of latches 117 in notches 119 not only keeps lid 116 seated and engaged with base 114 but the latch/notch engagement substantially prevents lid 116 from being lifted out of engagement with base 114 even if one pushes upwardly on first tab 132. This makes lid 116 more difficult for young children to lift up in order to try and take a drink from container 12. Furthermore, the latch/notch engagement also substantially prevents accidental rotation of lid 116 relative to base 114.

Figure 15:
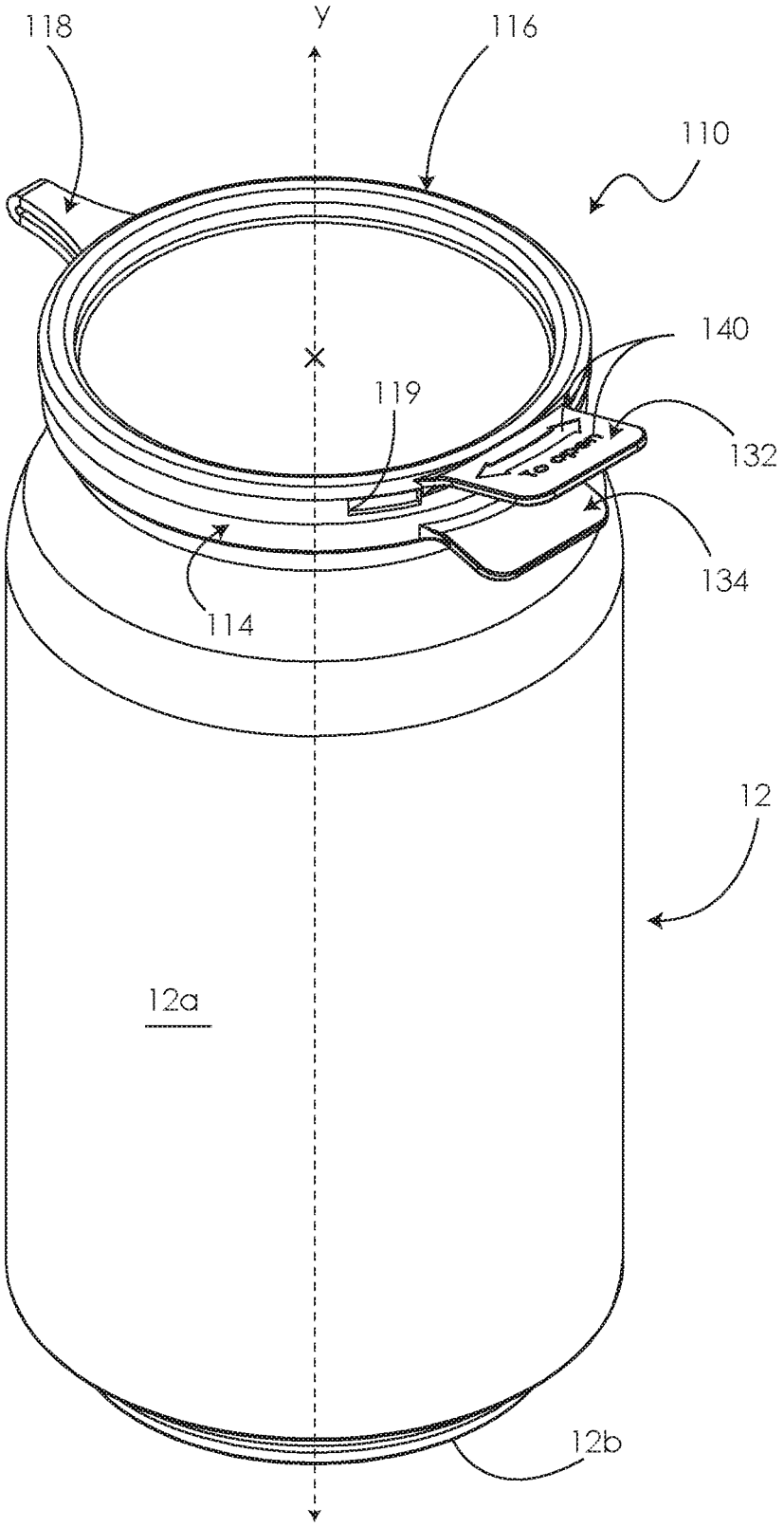
FIG. 15 is a perspective view of a beverage can with a second embodiment of a resealable cover engaged therewith in accordance with an aspect of the present disclosure.
Figure 16:
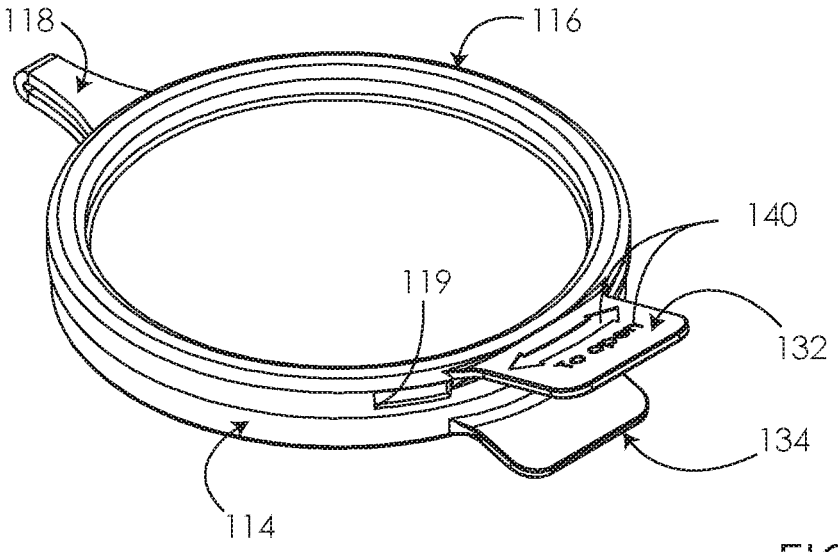
FIG. 16 is a perspective view of the resealable cover in accordance with an aspect of the present disclosure, where the cover is shown on its own and in a closed position.
Figure 27:
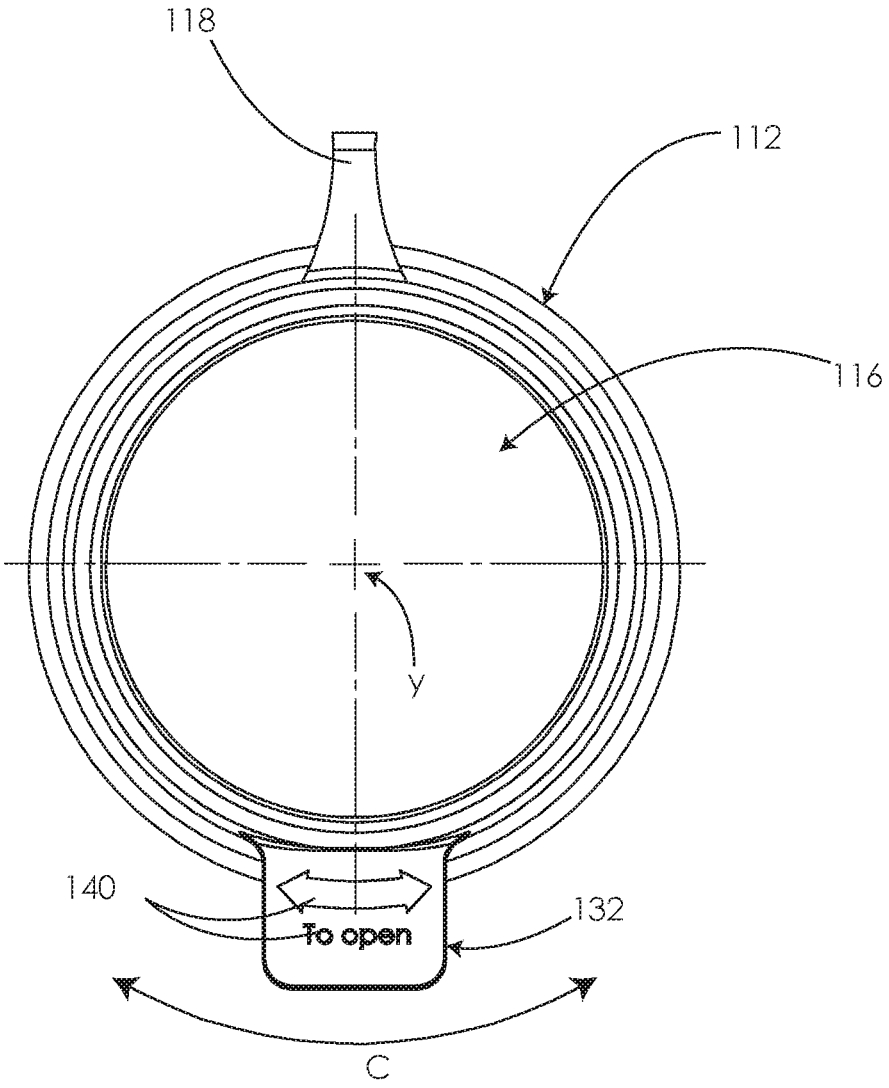
FIG. 27 is a top elevation view showing the cover in a locked position and indicating that the cover is rotatable relative to the base in either of a first direction or a second direction to disengage the latches from the notches; the container is shown in phantom.
Figure 28:
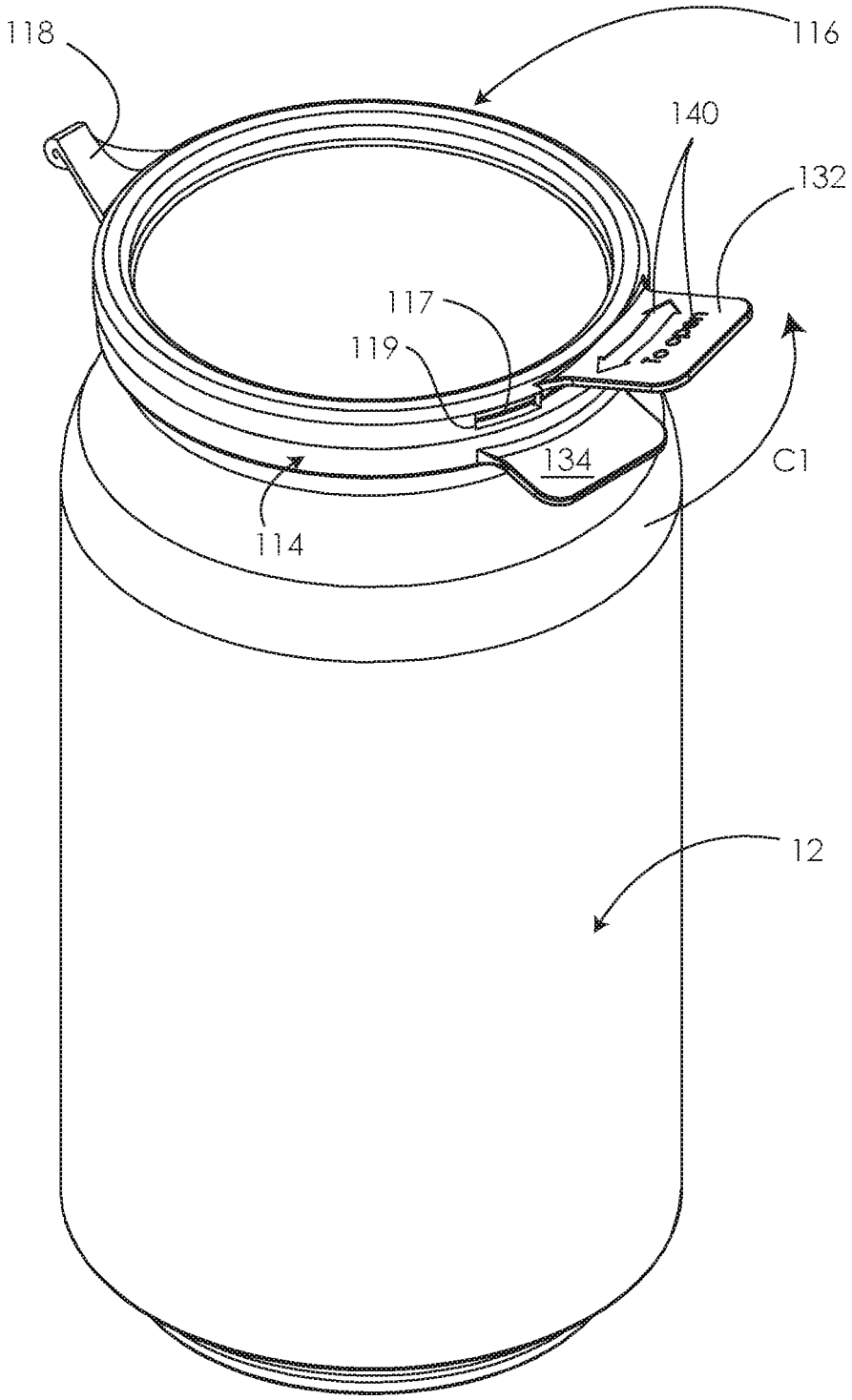
FIG. 28 is a perspective view of the cover shown engaged with the container and indicating how the cover is rotated from to disengage the latches from the notches.

When an adult decides to access the contents of container 12, he or she will grasp first tab 132 and will rotate lid 116 relative to base 114 about a vertical axis "Y" (FIGS. 15 and 27). The rotation may occur in either of a first direction or a second direction as indicated by the movement arrow "C" in FIG. 27. FIG. 22 shows that lid 116 has been rotated in the direction indicated by arrow "C1". The rotation of lid 116 relative base 114 causes hinge 118 to twist slightly and further causes first tab 132 to move out of vertical alignment with second tab 134. Second tab 134 may be utilized by the consumer to arrest any rotation of base 114 when lid 116 is rotated.

Rotation of lid 116 causes notches 119 to move out of engagement with latches 117. As a consequence of the disengagement of notches 119 from latches 117, lid 116 is freed to be able to be pushed upwardly, as indicated by arrow "E" in FIG. 29, and out of engagement with base 114. Unless the lid 116 is first rotated relative to base 114, lid 116 cannot be moved to the open position. Once lid 116 is moved to the open position, the contents of container 12 may be caused to flow out of opening 12*d*. The lid 116 may be moved back into engagement with base 114 at any desired time to once again close off access to opening 12*d*.

Referring now to FIGS. 30 to 37, there is shown a third embodiment of a resealable cover in accordance with an aspect of the present disclosure, generally indicated at 210. Cover 210 is substantially identical in structure and function to cover 110 except for certain regions that are described hereafter.

Cover 210 includes a base 214 and a lid 216 that are engaged with each other via a hinge 218. Base 214 is substantially identical in structure and function to base 114 except for a few features. Like base 114, base 214 includes at least one latch 217 that extends radially outwardly from outer surface 214*d* of the sidewall 214*d* of base 214. Base 114 includes two latches 117 located on either side of second tab 132. Base 214, on the other hand, includes four latches 217 that extend radially outwardly from outer surface 214*d*. Two latches 217 are located on either side of hinge 218 and two latches 217 are located on either side of second tab 234. The latches 217 proximate hinge 218 may be generally laterally aligned with each other. Similarly, the latches 217 proximate second tab 234 may be generally laterally aligned with each other. Latches 217 may be arranged to be spaced at regular intervals around the circumference of outer surface 214*d*.

Figure 30:
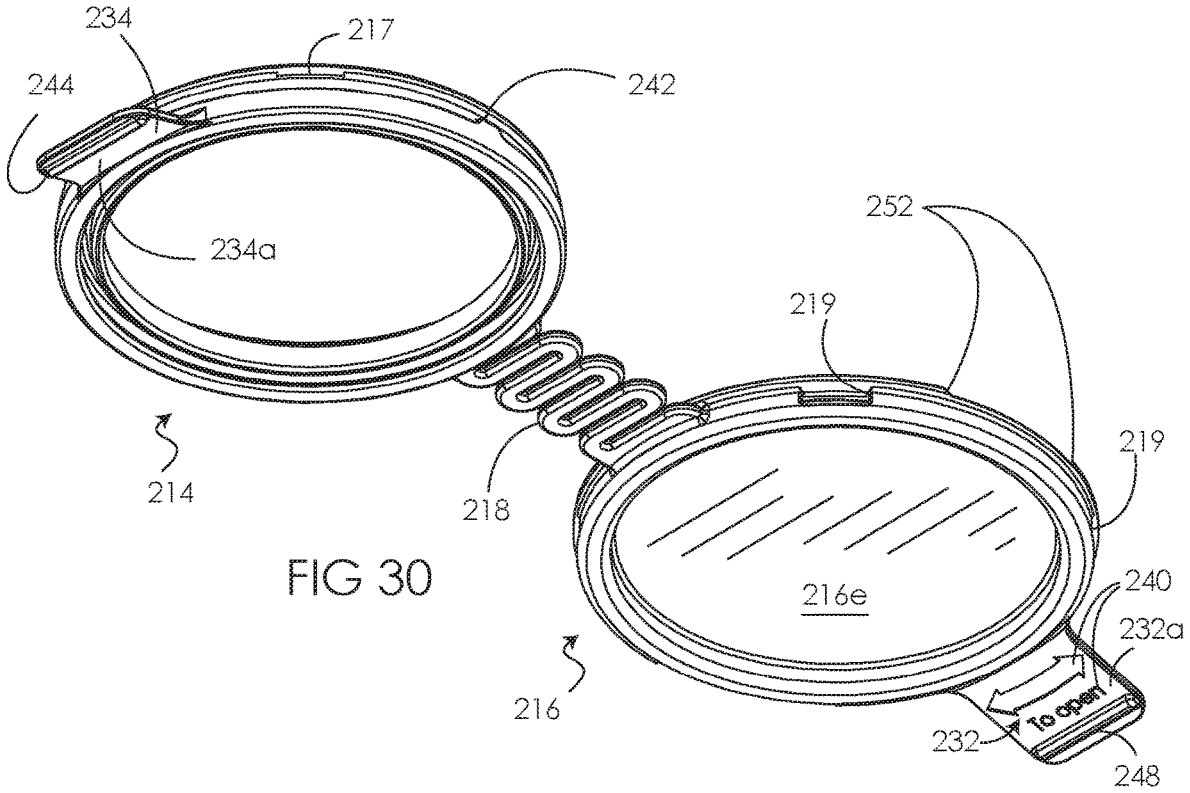
FIG. 30 is a first perspective view of a third embodiment of a resealable cover in accordance with an aspect of the present disclosure, shown in the open position.
Figure 31:
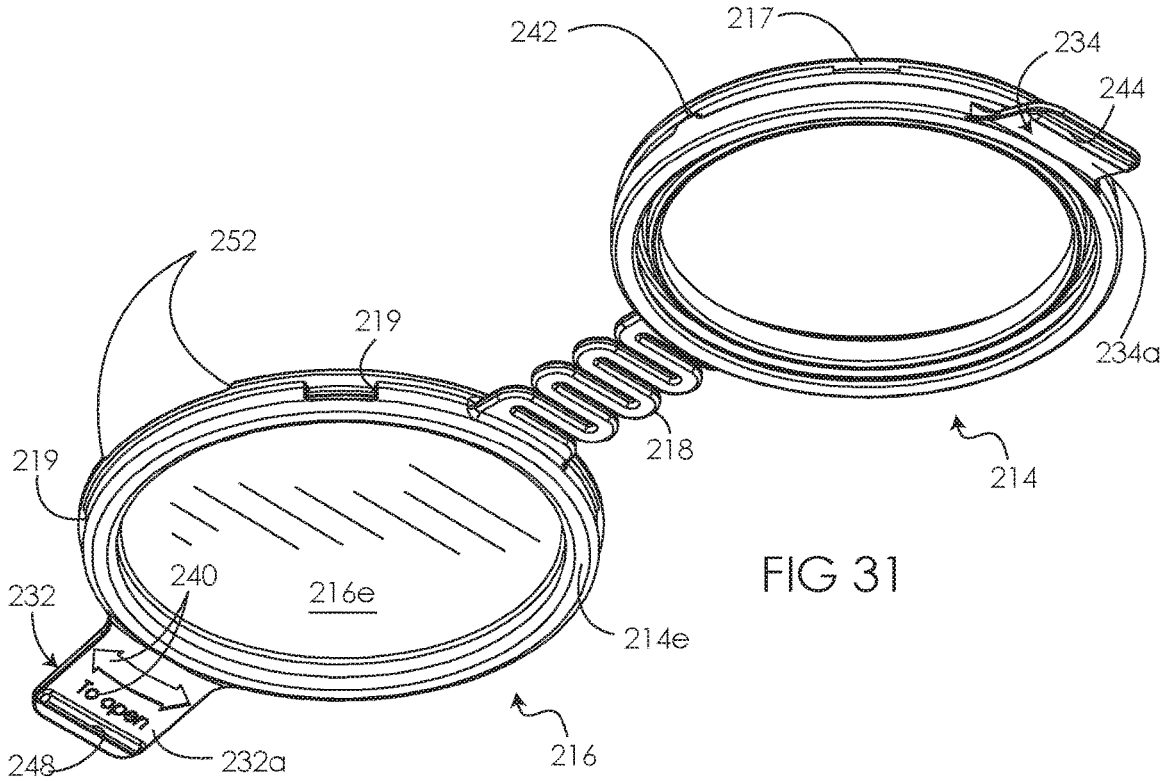
FIG. 31 is a second perspective view of the third embodiment of the resealable cover, shown in the open position.

Base 214 includes one or more shoulders 242 that were not provided on base 114. Shoulders 242 are provided as stops that will tend to arrest rotation of lid 216, as will be later described herein. As shown in FIG. 30, one shoulder 242 is located on a first section of the sidewall 214*d* of base 214 in a position between one of the latches 217 proximate hinge 218 and one of the latches 217 proximate second tab 234. FIG. 31 shows another shoulder 242 located on a second section of the sidewall 214*d* of base 214 in a position between the other latch 217 proximate hinge 218 and the other latch 217 proximate second tab 234. The two shoulders 242 are located opposite each other.

Figure 32:
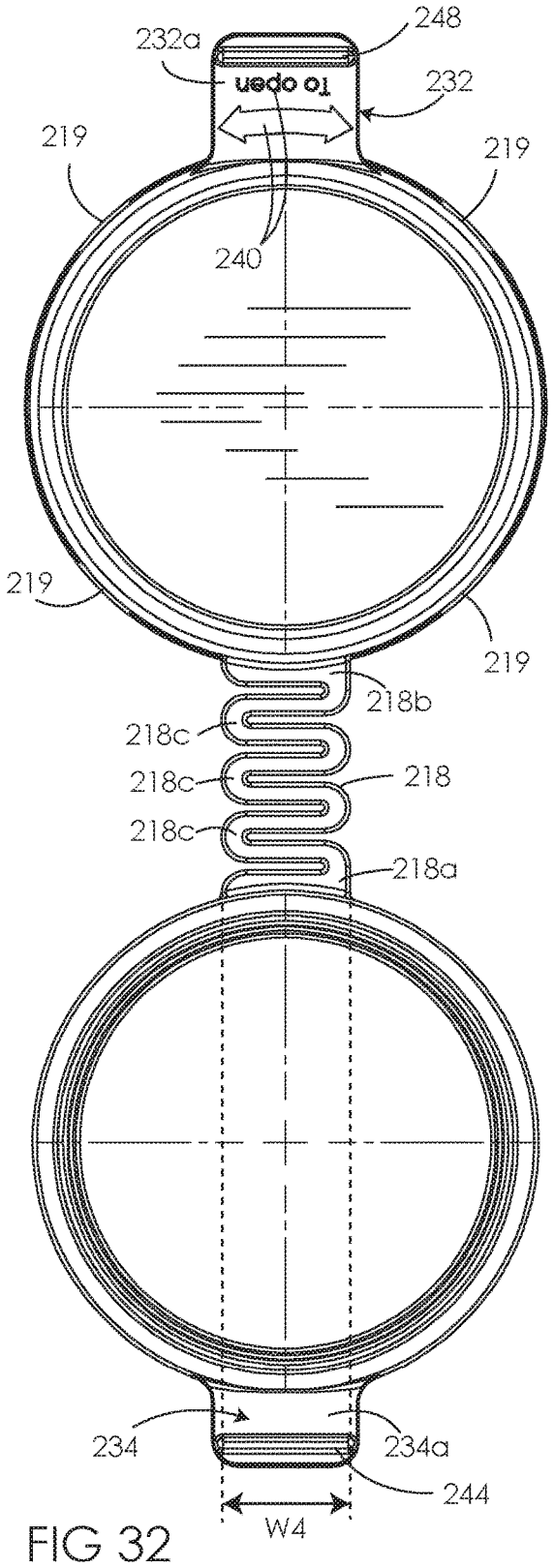
FIG. 32 is a top plan view of the resealable cover of FIGS. 30 and 31.
Figure 33:
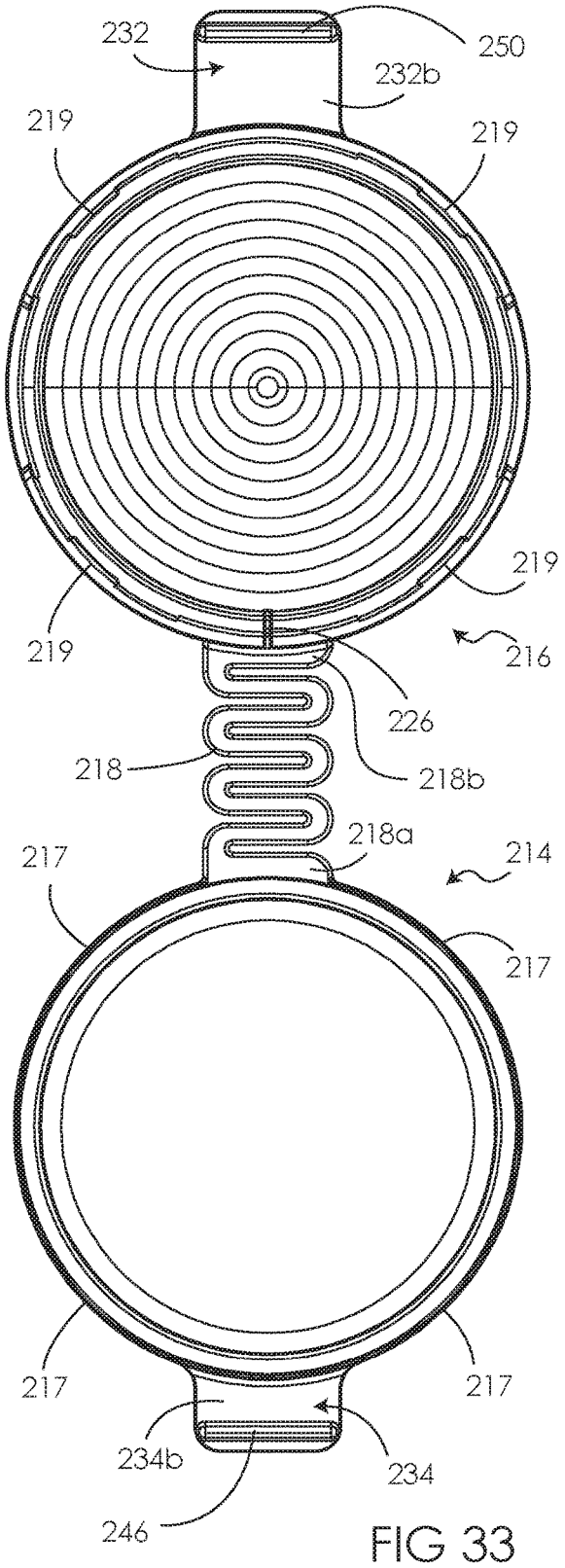
FIG. 33 is a bottom plan view thereof.
Figure 34:
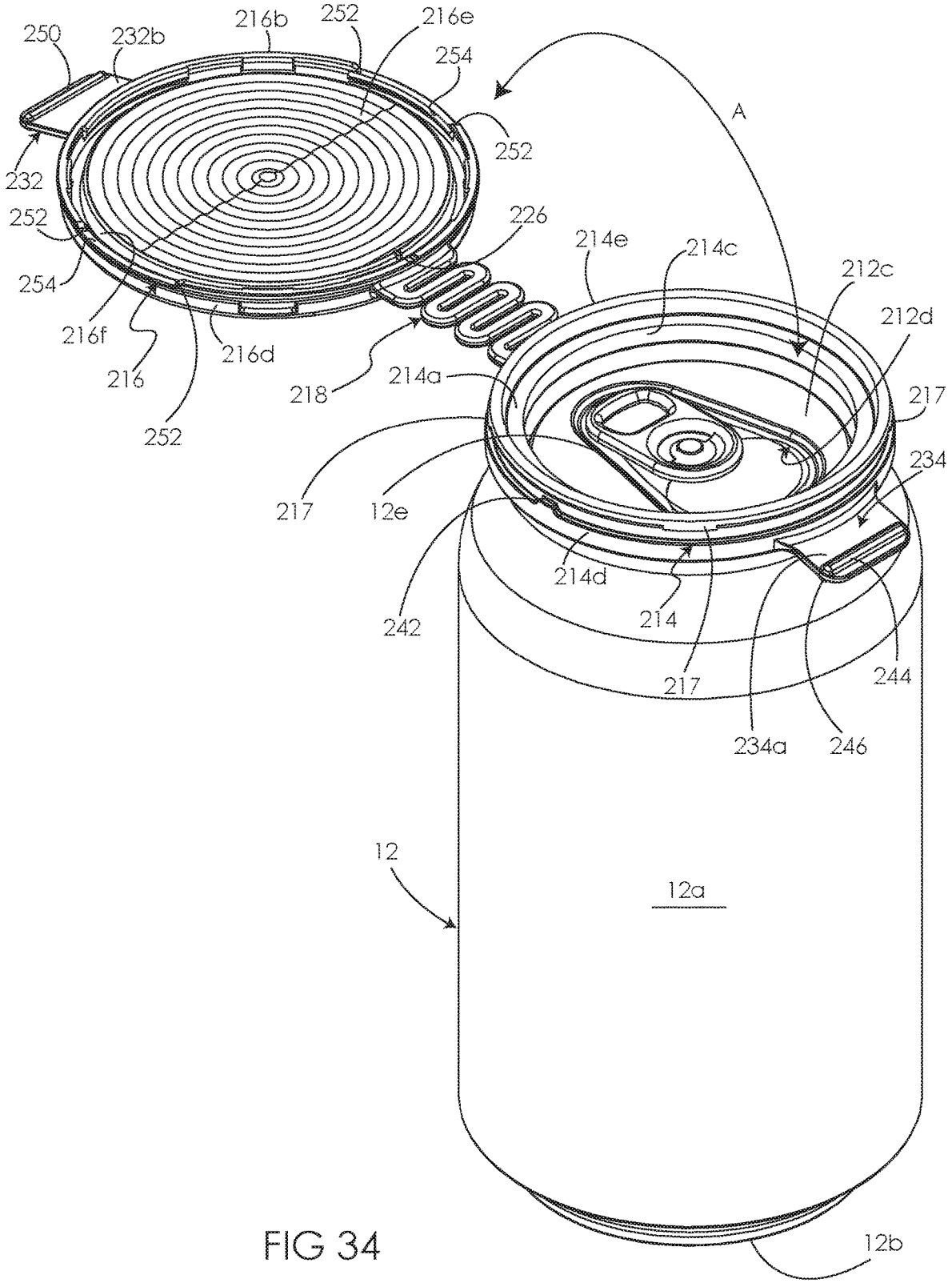
FIG. 34 is a perspective view of the cover of FIG. 30 shown engaged with a beverage can and in the open position.

Base 214 differs further from base 114 in that the configuration of second tab 234 is different from the second tab 134. The overall shape of second tab 234 may be substantially rectangular and similar to second tab 134. As best seen in FIGS. 32 and 33, Second tab 234 includes an upper surface 234*a* and a lower surface 234*b*. When base 214 is engaged on container 12 and lid 216 is moved to the closed position (as in FIG. 36), upper surface 234*a* of second tab 234 will be located adjacent first tab 232 and lower surface 234*b* will face toward bottom end 12*b* of container 12. An upper surface and a lower surface of second tab 134 are smooth and interruption free. The upper surface 234*a* and the lower surface 234*b* of second tab 234 are not smooth and interruption free but are, instead, each is provided with ridge 244, 246, respectively. (It will be understood that in some embodiments, only one of the upper surface 234*a* and lower surface 234*b* may include the associated ridge.)

Ridges 244, 246 may be located a distance outwardly from the outer surface of sidewall 214*d* of base 214. In one example, ridges 244, 246 may be aligned with each other. In one example, the ridges 244, 246 may be substantially straight along their entire length. Ridges 244, 246 may be provided for a user to more easily grip and manipulate second tab 234 and thereby base 214.

Lid 216 is substantially identical in structure and function to lid 116 except for the features described hereafter. Lid 116 defines a pair of notches 119 that are positioned to engage the two latches 117 on base 114. The two notches 119 are positioned on either side of second tab 132. Lid 216, on the other hand, defines four notches 219 in the outer surface 216*d* of the lid's sidewall. The four notches 219 are positioned so as to be selectively engageable with the four latches 217 on base 214. FIG. 33 shows that lid 216 defines two notches 219 on opposite sides of first tab 232 and another two notches 219 on opposite sides of hinge 218. The notches 219 on opposite sides of hinge 218 may be generally aligned with each other. Similarly, the notches 219 on either side of first tab 232 may be generally aligned with each other. Notches 219 may be spaced generally equidistantly around the circumference of the lid's sidewall. Notches 219 are located in positions complementary to latches 217 so that when cover 210 is moved to the closed position (FIG. 35), notches 219 and latches 217 are aligned and are able to be engaged with each other to secure lid 216 to base 214.

It will be understood that in other examples, the latches may be provided on the sidewall of lid 216 and the complementary notches may be defined in the sidewall of base 214 in such a way that the latches and notches are alignable and engageable with each other to secure lid 216 and base 214 together.

Lid 216 differs further from lid 116 in that first tab 232 includes some features not found in first tab 132. The overall shape of first tab 232 may be substantially similar to the overall shape of first tab 132. First tab 232 includes an upper surface 232*a* and a lower surface 232*b*. When lid 216 is moved to the closed position (FIG. 36), the lower surface 232*b* of first tab 232 is located opposite the upper surface 234*a* of second tab 234. The upper surface 232*a* of first tab 232 is visible to the user and includes indicia 240 thereon that informs the user as to how to move lid 216 to the open position. In first tab 132, the upper surface and the lower surface are substantially smooth and interruption free. First tab 232 differs from first tab 132 in that the upper surface 232*a* and lower surface 232*b* include a ridge 248, 250, respectively. (It will be understood that in some embodiments, only one of the upper surface 232*a* and lower surface 232*b* may include the associated ridge.)

Ridges 248, 250 may be located a distance outwardly from the outer surface of sidewall 216*d* of lid 216. In one example, ridges 248, 250 may be aligned with each other. In one example, the ridges 248, 250 may be substantially straight along their entire length. Ridges 248, 250 may be provided for a user to more easily grip and manipulate first tab 232 and thereby lid 216. In some examples, the ridges 248, 250 on first tab 232 are vertically aligned with the ridges 244, 246 on second tab 234.

FIGS. 30 and 31 also show that lid 216 includes shoulders 252 on sidewall 216*d*. Shoulders 252 are located a distance circumferentially apart from each other on sidewall 216*d* and define a depression 254 therebetween that can best be seen in FIG. 34. When lid 216 is moved to the closed position, shoulder 242 on base 214 is positioned in alignment with a portion of depression 254. When lid 216 is twisted in a first direction or a second direction relative to base 214, depression 254 moves relative to shoulder 242. When one of the shoulders 252 contacts either side of shoulder 242, rotation of lid 216 will be halted. The provision of shoulders 242, 252 and depression 254 on base 214 and lid 216 thereby provides a way for limiting rotational motion of lid 216 relative to base 214.

Hinge 218 differs from either of hinges 18 and 118 in a number of ways. Firstly, hinge 218 is sinuous in nature when viewed from the cover 210 is viewed from the top or bottom as in FIGS. 30 and 31. A first end 218*a* of the hinge 218 is connected to base 214 and a second end 218*b* of hinge 218 is connected to lid 216. Hinge 218 may include a plurality of substantially identically shaped waves 218*c* that are located between first end 218*a* and second end 218*b*. The waves 218*c* are regular in interval, meaning that they are of substantially the same amplitude and wavelength as each other. The width "W4" of hinge 218 is effectively substantially constant from first end 218*a* to second end 218*b*. FIGS. 30, 31, 34, and 37 also show that hinge 218 is of a substantially constant thickness "T1" (FIG. 37) from first end 218*a* to second end 218*b*. Hinge 218 therefore has a form of a three-dimensional wave. As is evident from FIGS. 35-37, the configuration of hinge 218 makes it possible to unfurl and twist the wave as the lid 216 is rotated.

All other components of base 214 and lid 216 are substantially identical to those of base 14, 114, and lid 16, 116 and will therefore not be further described herein. It should be noted that cover 210 also includes a trough 226 (FIGS. 33 and 34) that is in substantially in the same location as trough 26 of cover 10 and forms part of a serpentine pathway similar to that found in covers 10 and 110. This serpentine pathway, similar to the serpentine pathway in cover 10, permits outgassing from the space between the inner surface of lid 216 and a top surface of a liquid held within container 12.

Cover 210 is used in the following way. Base 214 may be engaged with container 12 in a similar fashion to the manner described with respect to base 14 or 114. In order to access the contents of container 12, the user will remove pull tab 12*e* and will drink the contents through opening 12*d*.

When it is desired to close off access to opening 12*d*, cover 210 has to be moved to the closed position. In order to close cover 210, lid 216 is moved relative to base 214 about hinge 218 and is positioned vertically above and aligned with base 214. Lid 216 is then pushed downwardly toward base 214 and thereby becomes engaged with base 214 in substantially the same manner as lid 116 is engaged with base 114. When lid 216 is pushed downwardly into sealing engagement with base 214, latches 217 on base 214 become engaged in notches 219 on lid 216. The engagement of latches 217 in notches 219 not only keeps lid 216 seated and engaged with base 214 but the latch/notch engagement substantially prevents lid 216 from being lifted out of engagement with base 214 even if one pushes upwardly on first tab 232. This makes lid 216 more difficult for young children to lift up in order to try and take a drink from container 12. Furthermore, the latch/notch engagement also substantially prevents accidental rotation of lid 216 relative to base 214.

Figure 35:
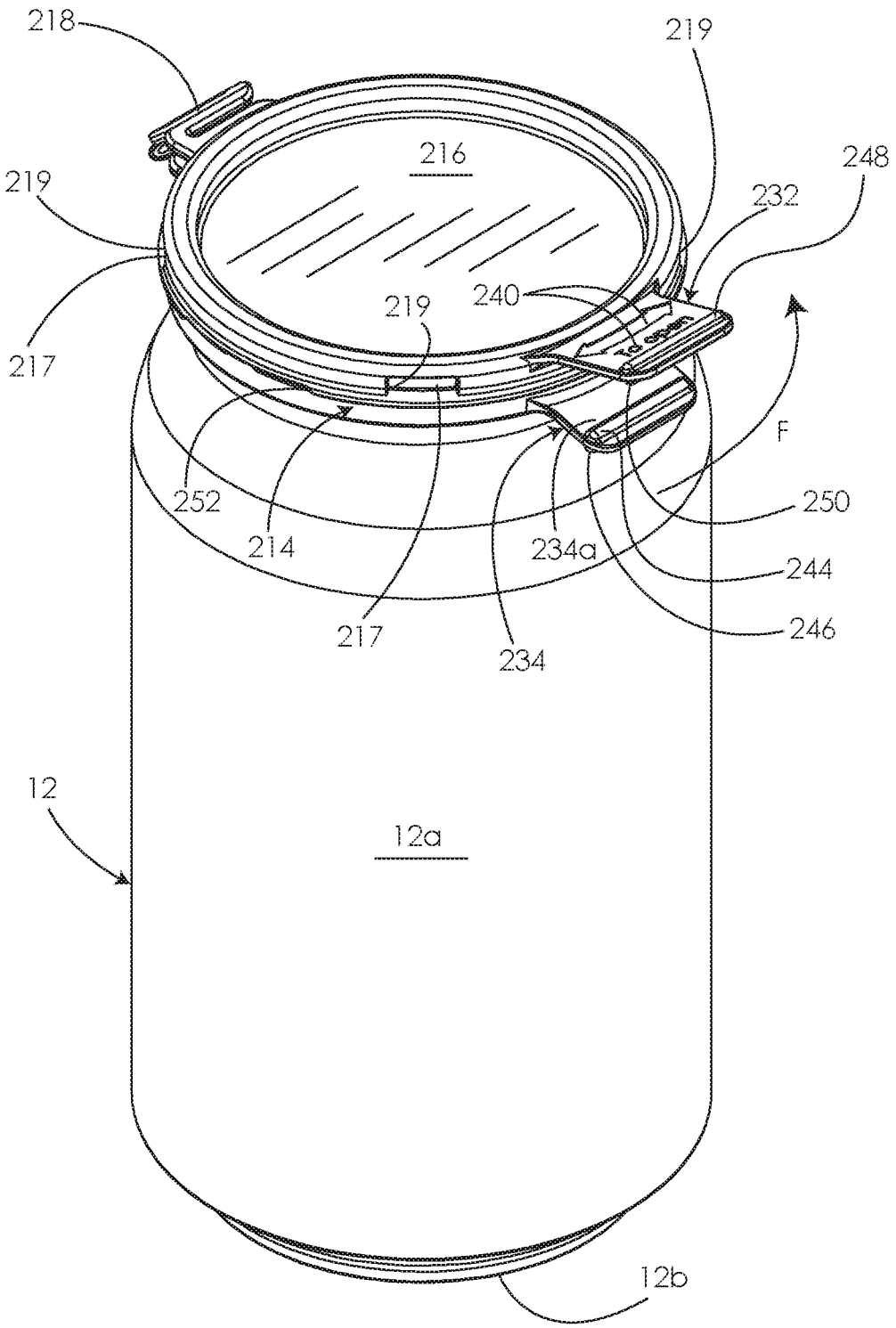
FIG. 35 is a perspective view of the beverage can with the cover engaged therewith and in a closed and latched position.
Figure 36:
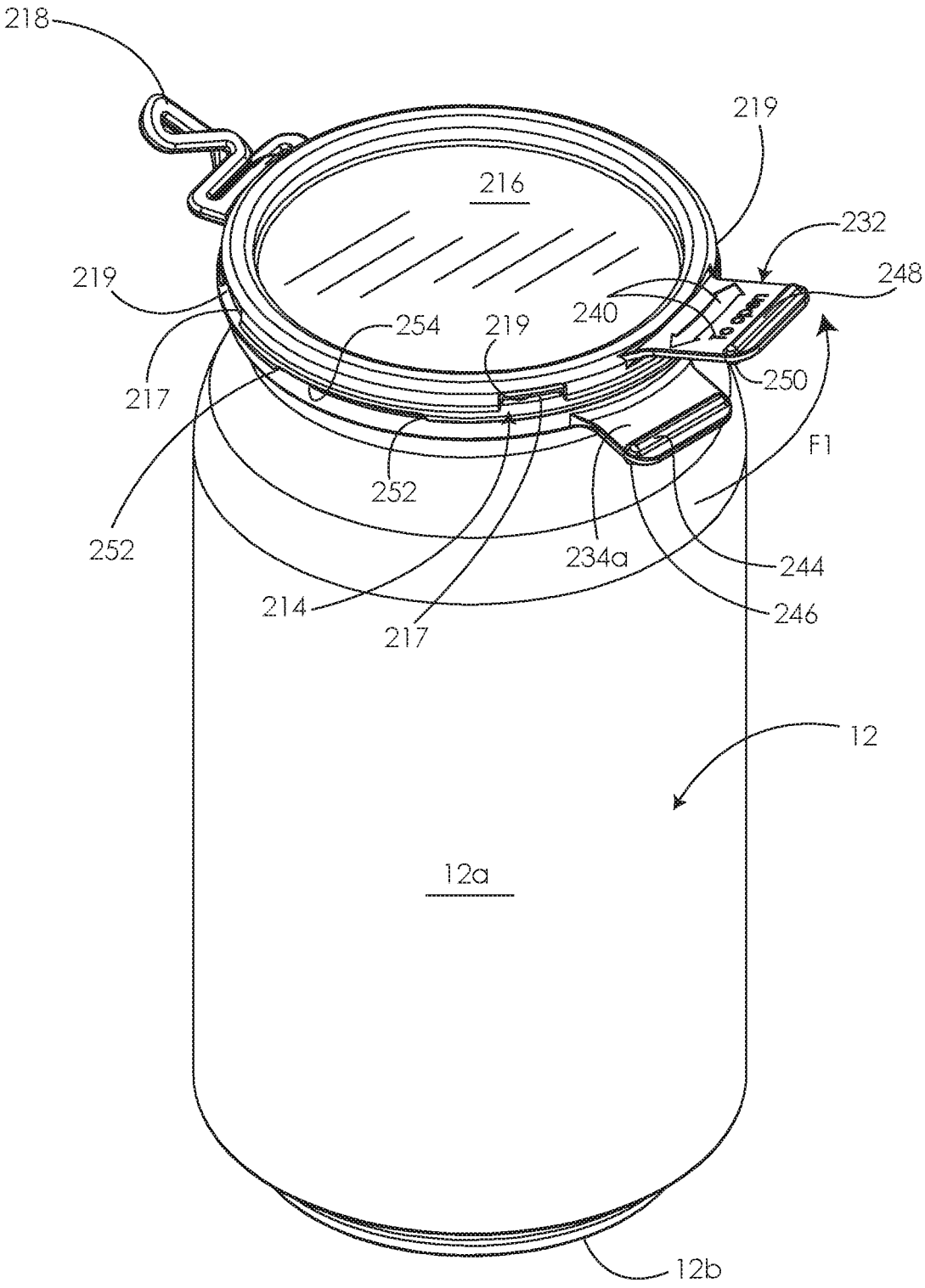
FIG. 36 is a perspective view of the beverage can and cover, where the cover has been partially rotated to disengage the latch.
Figure 37:
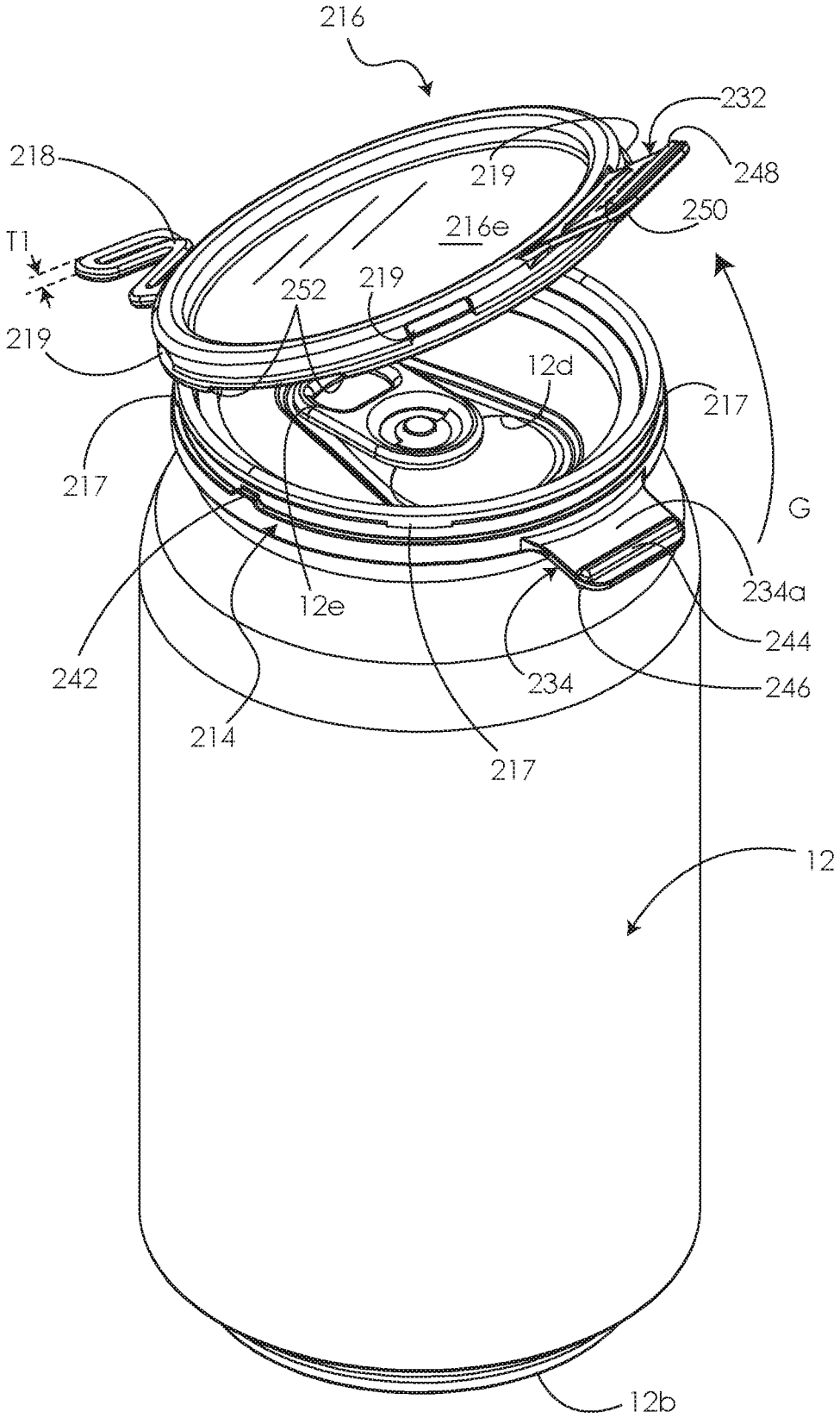
FIG. 37 is a perspective view of the beverage can and cover, where the cover is being moved into the open position from the position shown in FIG. 36 where the latch was disengaged.

When an adult decides to access the contents of container 12, he or she will grasp first tab 232 and will rotate lid 216 relative to base 214 in a similar manner to the rotation of lid 116 relative to base 114. The ridges 248, 250 on first tab 232 make it easier to grasp and manipulate first tab 232 and thereby lid 216. The rotation of lid 216 may occur in either of a first direction or a second direction such as the direction indicated by the movement arrows "F" shown in FIG. 35 and "F1" shown in FIG. 36 The extent of the rotation of lid 216 is controlled by shoulders 248, 252. The rotation of lid 216 relative base 214 causes hinge 218 to twist as illustrated in FIGS. 35 to 37 and causes first tab 232 to move out of vertical alignment with second tab 234. Second tab 234 may be utilized by the consumer to arrest any rotation of base 214 when lid 216 is rotated. The ridges 244, 246 make it easier for the consumer to grip second tab 234 to arrest the base's rotation.

Rotation of lid 216 causes notches 219 to move out of engagement with latches 217. As a consequence of the disengagement of notches 219 from latches 217, lid 216 is freed to be able to be pushed upwardly, as indicated by arrow "G" in FIG. 37, and out of engagement with base 214. Unless the lid 216 is first rotated relative to base 214, lid 216 cannot be moved to the open position. Once lid 216 is moved to the open position, the contents of container 12 may be caused to flow out of opening 12*d*. When lid 216 is no longer gripped, the hinge 218 will return to the position shown in FIG. 34. When the consumer is ready to close container 12 once again, the lid 216 may be moved back into engagement with base 214 to once again close off access to opening 12*d*.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "bottom", "over", "top", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10 % of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A cover for use in sealing a container comprising:

a base adapted to be engaged with an upper rim of a container; said base including:

a wall having a top surface, a bottom surface, an inner surface and an outer surface, wherein the inner surface and outer surface extend between the top surface and bottom surface, and wherein the inner surface bounds and defines an opening through which an upper wall of the container is selectively accessible; and a first sealing member extending upwardly beyond the top surface of the base; and a lid including:

a top wall;

a sidewall circumscribing the top wall; wherein the sidewall has a top surface, a bottom surface, an inner surface, and an outer surface;

a channel bounded and defined by an interior surface of the lid;

wherein an opening to the channel is provided in the bottom surface of the lid's sidewall;

wherein the first sealing member of the base is received through the opening in the bottom surface and into the channel of the lid when the lid is moved to a closed position, and the first sealing member is removed from the channel when the lid is moved to an open position; and a passageway is defined between a portion of the lid and a portion of the base when the lid is in the closed position; wherein the passageway is adapted to be in fluid communication with air surrounding an exterior surface of the cover and a space defined between the top wall of the lid and the upper wall of the container.

2. The cover as defined in claim 1, wherein the passageway is at least partially defined between the first sealing member of the base and the interior surface of the lid that bounds and defines the channel.

3. The cover as defined in claim 2, wherein the first sealing member is of smaller dimensions than the interior surface of the lid that defines the channel, and wherein a gap is defined between an exterior surface of the first sealing member and the interior surface of the lid that defines the channel, wherein the gap forms a part of the passageway.

4. The cover as defined in claim 1, further comprising a trough defined in one of the bottom surface of the sidewall of the lid and the top surface of the wall of the base; wherein the trough forms a part of the passageway.

5. The cover as defined in claim 4, further comprising a hinge extending between the sidewall of the lid and the wall of the base; and wherein the trough is located proximate the hinge.

6. The cover as defined in claim 1, wherein the bottom surface of the sidewall of the lid is sinuous in shape.

7. The cover as defined in claim 6, wherein, when the lid is in the closed position, the sinuously-shaped bottom surface of the lid periodically contacts the top surface of the base, and wherein at least one air pocket is formed where contact between the bottom surface of the sidewall of the lid and the top surface of the wall of the base is broken.

8. The cover as defined in claim 7, wherein the at least one air pocket forms a part of the passageway.

9. The cover as defined in claim 1, further comprising:

a second sealing member provided on the lid; wherein the second sealing member is adjacent the bottom surface of the lid and extends at least partially across an opening to the channel, wherein the opening is defined in the bottom surface of the lid.

10. The cover as defined in claim 9, further comprising:

a first groove defined in the first sealing member of the base; wherein the first groove is located such that the second sealing member is aligned with and received in the first groove when the lid is moved to the closed position.

11. The cover as defined in claim 10, wherein the second sealing member has an exterior profile that differs at least partially from an interior profile of the first groove; and where at least one space is defined where contact is broken between the exterior profile of the second sealing member and the interior profile of the first groove when the lid is moved to the closed position.

12. The cover as defined in claim 11, wherein the at least one space forms a part of the passageway.

13. The cover as defined in claim 1, further comprising:

a second groove defined in the bottom surface of the base, said second groove being adapted to receive the upper rim of the container therein.

14. The cover as defined in claim 1, wherein the passageway follows a serpentine path between the portion of the lid and the portion of the base.

15. The cover as defined in claim 1, further comprising a hinge extending between the sidewall of the lid and the wall of the base.

16. The cover as defined in claim 15, wherein the hinge is of a width that keeps the lid substantially aligned with the base.

17. The cover as defined in claim 15, wherein the hinge is of a width that permits the lid to rotate about a longitudinal axis and relative to the base when the lid is in the closed position.

18. The cover as defined in claim 15, wherein the hinge is sinuous in shape when the cover is in the open position and is viewed from above.

19. The cover as defined in claim 1, further comprising a tab extending outwardly from an exterior surface of the sidewall of the lid.

20. The cover as defined in claim 19, further comprising a second tab extending outwardly from an exterior surface of the wall of the base; wherein the second tab is vertically aligned with the tab on the lid.

21. The cover as defined in claim 1, further comprising at least one notch provided on one of the sidewall of the lid and the wall of the base, and at least one latch provided on the other of the sidewall of the lid and the wall of the base; wherein the at least one latch is received in the at least one notch when the lid is moved to the closed position.

22. The cover as defined in claim 21, wherein the lid is rotated at least partially relative to the base when in the closed position to disengage the at least one latch from the at least one notch.

23. A method of using a cover on a container holding a liquid, said method comprising:

engaging a base of a cover on an upper rim of a container that holds a liquid;

aligning a channel defined in a bottom surface of a lid of the cover with a first sealing member extending upwardly from the base;

pushing the lid downwardly toward the base to engage the first sealing member in the channel; and providing a pathway between a portion of the lid and a portion of the base for gas to escape from a space defined between the lid and an upper surface of the liquid to the air surrounding an exterior surface of the cover.

24. The method as defined in claim 23, further comprising:

grasping a tab on the lid;

moving the tab upwardly;

disengaging the first sealing member from the channel;

moving the lid to an open position relative to the base; and gaining access to the liquid in the container through an opening defined in the base and through an opening defined in an upper wall of the container.

25. The method as defined in claim 24, wherein engaging of the tab on the lid is preceded by:

rotating the lid relative to the base and about a longitudinal axis of the container, wherein the longitudinal axis extends between the upper wall of the container and a lower wall of the container;

disengaging latches on the base from notches on the lid as the lid is rotated.

26. The method as defined in claim 23, further comprising:

receiving at least one latch provided on one of the base and the lid into at least one notch defined in the other of the base and the lid; and preventing the lid from moving from a closed position to an open position until the at least one latch is disengaged from the at least one notch.

27. In combination:

a container having a lower wall and a sidewall; said lower wall and sidewall bounding and defining an interior chamber adapted to hold a quantity of carbonated liquid therein; and a sealing cover that is selectively engageable with an upper rim of the sidewall of the container; wherein the sealing cover comprises;

a base engageable with the upper rim of a container; said base including:

a wall having a top surface, a bottom surface, an inner surface and an outer surface, wherein the inner surface and outer surface extend between the top surface and bottom surface, and wherein the inner surface bounds and defines an opening through which an upper wall of the container is selectively accessible; and a first sealing member extending upwardly beyond the top surface of the base; and a lid including:

a top wall;

a sidewall circumscribing the top wall; wherein the sidewall has a top surface, a bottom surface, an inner surface, and an outer surface;

a channel bounded and defined by an interior surface of the lid; wherein an opening to the channel is provided in the bottom surface of the lid's sidewall;

wherein the first sealing member of the base is received through the opening in the bottom surface and into the channel of the lid when the lid is moved to a closed position, and the first sealing member is removed from the channel when the lid is moved to an open position; and a passageway is defined between a portion of the lid and a portion of the base when the lid is in the closed position; wherein the passageway is in fluid communication with air surrounding an exterior surface of the cover and a space defined between the top wall of the lid and the upper wall of the container.

* * * * *